US011446209B2

(12) United States Patent
Barkman et al.

(10) Patent No.: US 11,446,209 B2
(45) Date of Patent: Sep. 20, 2022

(54) ARRANGEMENT AND METHOD FOR PROVIDING A FORMULATION FOR PARENTERAL NUTRITION

(71) Applicant: Fresenius Kabi AB, Uppsala (SE)

(72) Inventors: Tomas Barkman, Uppsala (SE); Joakim Bohlin, Uppsala (SE)

(73) Assignee: Fresenius Kabi AB, Uppsala (SE)

( * ) Notice: Subject to any disclaimer, the term of this patent is extended or adjusted under 35 U.S.C. 154(b) by 105 days.

(21) Appl. No.: 16/982,235

(22) PCT Filed: Apr. 12, 2019

(86) PCT No.: PCT/EP2019/059504

§ 371 (c)(1),
(2) Date: Sep. 18, 2020

(87) PCT Pub. No.: WO2019/197650

PCT Pub. Date: Oct. 17, 2019

(65) Prior Publication Data

US 2021/0030624 A1 Feb. 4, 2021

(30) Foreign Application Priority Data

Apr. 13, 2018 (EP) ..... 18167291

(51) Int. Cl.
*A61J 1/14* (2006.01)
*A61J 3/00* (2006.01)
(Continued)

(52) U.S. Cl.
CPC ..... *A61J 3/002* (2013.01); *A61J 1/065* (2013.01); *A61J 1/1406* (2013.01); *A61J 1/2027* (2015.05); *A61J 1/2089* (2013.01)

(58) Field of Classification Search
CPC ..... A61J 1/065; A61J 1/1406; A61J 1/2027; A61J 1/2089; A61J 3/002; A61J 2205/70
See application file for complete search history.

(56) References Cited

U.S. PATENT DOCUMENTS 3,720,240 A * 3/1973 Gardner ..... A61M 5/40 141/9
4,336,802 A * 6/1982 Stone ..... A61J 1/2089 604/416
(Continued)

FOREIGN PATENT DOCUMENTS

WO 97/46203 A1 12/1997
WO WO-2005065625 A1 * 7/2005 ..... A61J 1/1406
(Continued)

*Primary Examiner* — Nicolas A Arnett
(74) *Attorney, Agent, or Firm* — Occhiuti & Rohlicek LLP

(57) ABSTRACT

The invention relates to an arrangement and a method for preparing a formulation for parenteral nutrition. In more detail the invention relates to a mixing system for parenteral nutrition, comprising at least two containers, wherein the at least two containers form a modular system. The mixing system comprises a septum, which is pierceable by a spike or a needle and a hanger for attaching the mixing system to an infusion rack. A first container comprises a male connector and a second container comprises a female connector, which fit together. First and second container can be coupled together, thereby forming a channel, which enables the passage of liquid and the mixing of the ingredients of the containers.

16 Claims, 18 Drawing Sheets

(51) Int. Cl.
*A61J 1/20* (2006.01)
*A61J 1/06* (2006.01)

(56) References Cited

U.S. PATENT DOCUMENTS 4,368,729 A * 1/1983 Dossin ..... A61J 1/10 604/410
4,439,183 A * 3/1984 Theeuwes ..... A61M 5/1407 604/251
4,521,211 A * 6/1985 Theeuwes ..... A61M 5/1407 604/251
5,037,390 A * 8/1991 Raines ..... A61J 3/002 211/74
5,871,477 A * 2/1999 Isono ..... A61M 1/287 604/416
6,355,161 B1 * 3/2002 Shah ..... A61M 1/1668 210/321.71
6,645,171 B1 * 11/2003 Robinson ..... A61J 1/2089 604/82
9,345,640 B2 * 5/2016 Mosler ..... A61J 1/2075
2009/0182300 A1 * 7/2009 Radmer ..... A61M 5/1409 604/411
2010/0218846 A1 * 9/2010 Kriheli ..... A61J 1/2096 141/5
2010/0300904 A1 * 12/2010 Sharon ..... B65D 11/04 220/505
2012/0046636 A1 * 2/2012 Kriheli ..... A61M 5/162 604/414
2014/0318995 A1 * 10/2014 Eilertsen ..... A61J 1/2093 206/219
2021/0015707 A1 * 1/2021 Barkman ..... A61J 1/1462

FOREIGN PATENT DOCUMENTS

WO 2007/101784 A1 9/2007
WO 2013/076129 A1 5/2013

* cited by examiner

Detail A

Detail C

ARRANGEMENT AND METHOD FOR PROVIDING A FORMULATION FOR PARENTERAL NUTRITION

CROSS-REFERENCE TO RELATED APPLICATIONS

This application is a national phase under 35 U.S.C. 371 of International Application No. PCT/EP2019/059504, which was filed on Apr. 12, 2019 and which claims the benefit of the Apr. 13, 2018 priority date of European Application No. 18167291.6, the contents of all of which are hereby incorporated by reference in their entirety.

FIELD OF THE INVENTION

The invention relates to an arrangement and a method for preparing a formulation for parenteral nutrition comprising liquid components for parenteral nutrition.

BACKGROUND OF THE INVENTION

A liquid for parenteral nutrition typically comprises fat, glucose and amino acids. There are known from praxis compounders for mixing parenteral nutrition. Such compounders can mix individual compositions. However, such devices can only be operated economically if large amounts of parenteral nutrition are needed at the location of the compounder.

However, it is not possible to store a liquid comprising all these three main components already mixed for a longer period.

Therefore, there exist also three chamber bags, which comprise separate compartments, each compartment comprising one component of the parenteral nutrition. For example, the Kabiven® three-chamber bag, which is rolled directly before use. By rolling the bag, seams between the chambers are peeled-off so that the compartments are combined to one volume and the liquids are mixed.

Such three-chamber bags are safe and easy to use. However, for a given bag neither the ratio nor the composition of the different components of the liquid can be changed. Further, the storage lifetime of the entire bag is limited to the lifetime of the component with the shortest lifetime. This typically is the fat emulsion. Furthermore, all components have to be shipped together requiring space. However, some components, e.g. glucose solution, are easy to manufacture and could be manufactured in less-specialized production sites, wherein fat emulsions are complex to manufacture, so they generally are produced in specialized production sites.

OBJECT OF THE INVENTION

Given this background, it is an object of the invention to provide an improved mixing system for parenteral nutrition which is easy and safe to handle.

SUMMARY OF THE INVENTION

The object of the invention is achieved by providing a mixing system, a container for a mixing system and by providing a method for mixing parenteral nutrition according to one of the independent claims.

Various embodiments of the invention are subject of the dependent claims, of the description and of the drawings.

The invention relates to a mixing system for parenteral nutrition. The mixing system comprises at least two containers, wherein the at least two containers form a modular system, so that the containers can be combined by the user.

A first container of the at least two containers is filled with a first liquid for parenteral nutrition and a second container of the at least two containers is filled with a second liquid for parenteral nutrition.

The mixing system further comprises a septum, which is pierceable by a spike or a needle, and a hanger to attach the mixing system to an infusion rack.

The first container comprises a male connector and the second container comprises a female connector which fit together.

In addition, the first and the second container can be coupled together by connecting the male connector of the first container to the female connector of the second container, thereby forming a channel which enables the passage of liquid and the mixing of the first and the second liquid.

According to the invention the passage of liquid is automatically formed when the first and the second container are coupled, preferably fully coupled. The passage enables mixing of the first and second liquid, which can be e.g. promoted by agitating the connected containers.

When the containers are connected and the channel, which enables the passage of liquid, is formed, the volume of the at least two containers preferably forms a mixing chamber, wherein the liquids are mixed by passing them through the entire volume formed by both containers.

According to an embodiment of the invention, the mixing system comprises at least three containers. In particular, a first container comprises amino acids, a second container comprises glucose and/or a third container comprises fat.

According to a further embodiment of the invention, the first container additionally comprises a female connector and the second container additionally comprises a male connector, which fit together. This embodiment enables the provision of a modular system, wherein the at least two containers can be coupled in a varying order.

According to a further embodiment of the invention, the at least two containers comprise a locking device to engage a non-detachable connection between the at least two containers in order to form a pre-assembled mixing system.

Preferably, the locking device is embodied to engage the non-detachable connection before the channel, which enables that the passage of liquid, is formed.

By engaging a non-detachable connection, the containers are mechanically connected, but the passage of liquid is not yet enabled.

Hence, in a first step, a preassembled mixing system can be provided.

Preferably, a sealed non-detachable connection is formed so that a volume of the connectors between the containers is or remains sterile.

The passage of liquid can be established or provided in a second step. According to an embodiment, the containers are non-detachably, in particular non-twistably, locked when the channel is formed. Hence, the user cannot interrupt the passage of liquid.

Preferably, the locking device is embodied to provide an optical and/or acoustical signal when the containers are non-detachably connected and/or when the containers are non-detachably locked when forming the channel or after forming the channel.

E.g., the user can screw together the at least two containers. In a first step or in a first state, the containers engage a mechanical connection and are non-detachably connected in a first position, e.g. by a latch of a locking device which snaps into a recess. This can be signaled to the user by a first "click", which is, e.g., generated when the latch snaps into the recess. Hence, in this first step, a preassembled mixing system is provided.

Then, in a second step, the user continues to screw the containers and a passage of liquid is now formed. In a second step or in a second state, the containers are non-detachably locked, which is signaled to the user by a second "click", which is generated, e.g., when the latch snaps into a second recess.

Preferably, the containers are embodied so that the necessary torque for performing the second step is higher.

According to a further embodiment of the invention, at least one of the containers comprises the hanger.

Preferably, the hanger is mounted in an area of the male or the female connector of the containers.

According to another embodiment of the invention, the hanger is provided as a separate component of the mixing system, which can be connected to the first and/or second container.

In particular, the hanger can be connected to a male or female connector, preferably to the female connector of the first or second container.

According to an embodiment of the invention, the containers are embodied as molded bottles, in particular as blow-molded plastic bottles.

Containers of the mixing system are preferably inherently stable. Therefore, the containers do not collapse when the mixing is performed by agitating.

Preferably, the containers can be coupled together by screwing, preferably with less than one turn.

According to an embodiment of the invention, the mixing system further comprises an ampoule holder or a vial holder, which is connectable with at least one of the containers.

The ampoule or vial holder comprises a receiving space in order to hold an ampoule or a vial. The ampoule or vial is generally filled with a liquid, in particular a pharmaceutical liquid. The ampoule or vial holder can be inserted into one of the containers. Preferably, the ampoule or vial holder comprises a male or female connector, which fits with a connector of the first or second container.

According to an embodiment of the invention, the mixing system further comprises a cartridge which is filled with an ingredient, in particular an ingredient embodied as a powder. Preferably, the cartridge is connectable to the female connector of one of the containers. The cartridge can comprise a pharmaceutical powder or a micro-nutrition powder, which can be inserted into the mixing volume formed by the connected containers. In particular, the cartridge is automatically opened, when the cartridge becomes connected to one of the containers.

According to an embodiment of the invention, the at least two containers are pre-assembled and inserted into a secondary package. The secondary package preferably comprises an oxygen diffusion barrier. This embodiment enables the provision of a flexible and fast delivery of preassembled mixing systems with individual compositions of ingredients.

The male and/or the female connector of at least one of the containers are preferably sealed with a detachable tamper-evident closure. The tamper-evident closure for instance can be embodied as a metal or plastic film, which can be peeled off from an upper surface of the connector.

In order to provide a fast mixing, e.g. by agitating, the channel, which forms the passage of liquid, preferably has an open surface area of at least 0.25 $cm^2$, in particular preferred of at least 0.5 $cm^2$.

According to an embodiment of the invention, an inner volume of at least one of the containers is partially filled with gas. In particular, at least 10%, preferably 20%, of the inner volume of the container is filled with gas. At least one container, which is filled with gas, enables the flow of liquid from one container into another container, thereby mixing the liquids in the containers. The used gas is preferably an inert gas, in particular nitrogen.

According to a further embodiment of the invention, one of the containers comprises a housing embodied as a bellows. The housing, which is embodied as a bellows, can be used to provide an additional volume for mixing and/or can be used as a pump for pumping the liquid through a mixing chamber which is formed by the connected containers.

According to an embodiment of the invention, at least one container of the mixing system is collapsible. In particular, one or two collapsible containers can be used as a buffer volume when mixing.

The septum of the mixing system can be placed in the male and/or the female connector.

In particular, the septum can be embodied as a separate component, which can be connected to the male or the female connector. In one embodiment the septum can be inserted into the male or the female connector, preferably into the male connector.

The septum may comprise connection means, which are connectable to the male and/or the female connector.

According to an embodiment of the invention, the mixing system comprises a membrane breaker insert, which is embodied as a separate component, which can be placed between the male connector and the female connector.

The membrane breaker insert opens a membrane of the connectors, in particular during above mentioned second step, in order to enable the passage of liquid.

According to another embodiment of the invention, the membrane breaker insert is inserted either into the male connector or into the female connector. According to this embodiment, the membrane breaker insert is an integral component of one of the connectors. The membrane breaker insert preferably opens both, the membrane of the male connector and the membrane of the female connector, when the containers are connected, in particular when the containers are screwed together.

The membrane breaker insert can be embodied as a ring-shaped insert, wherein the sidewall of the ring opens the membrane and wherein the liquid can flow through a channel formed by the ring.

The invention further relates to a container for the mixing system. The container is filled with preferably liquid parenteral nutrition, in particular with a liquid for parenteral nutrition, and comprises a male connector and a female connector. The male connector is placed on the opposite side of the container compared to the female connector. The male connector and the female connector are embodied to engage a mechanical connection with a male connector or a female connector respectively of another container in order to form a channel, which enables the passage of liquid.

By proving a container with a male connector and a female connector which are placed opposite to each other, the container can be used as a component of a modular system, wherein a multitude of containers can be coupled in a variable order. The containers preferably automatically form a mixing volume, when they are connected.

According to a first embodiment of the invention, the male and/or the female connector comprises/comprise a membrane.

Preferably the male and/or the female connector has/have a membrane breaker insert, which opens the membrane, when the container and a further container are coupled, in particular are screwed together.

The membrane breaker insert is preferably placed in a duct of the male connector.

In particular, the membrane breaker insert is placed between a membrane and a tamper-evident seal. To connect the container to another container, the tamper-evident seal is removed and the male connector of the container is connected to the female connector of the other container. When the containers are connected or coupled, in particular when the containers are screwed together, the membrane breaker insert opens both the membrane of the male connector of the container and the membrane of the female connector of the other container. Thereby, a channel for the passage of liquid is formed and the volume of the containers can be used as mixing volume.

The invention further relates to a method for mixing liquids for parenteral nutrition, in particular by using a mixing system and/or a container as described above.

The method for mixing a liquid for parenteral nutrition comprises the steps:

connecting at least a first container comprising a first liquid for parenteral nutrition to a second container comprising a second liquid for parenteral nutrition, thereby forming a fluid connection between the first and the second container;

mixing the first and the second liquid;

preferably inserting a spike or a needle into a septum which seals the first or second container.

Preferably, the first and the second container are preassembled in a first step or in a first state, thereby forming a mechanical non-detachable connection without a fluid connection.

In a second step or in a second state, the fluid connection between the containers is established. In particular, the fluid connection is established by twisting the containers against each other, preferably by screwing.

The mixing is preferably performed by agitating the connected containers. In particular, the entire volume of the first container and of the second container forms a mixing chamber.

Preferably, a third container, which comprises a third liquid for parenteral nutrition, is connected to said first or second container, thereby forming a fluid connection of said first, second and third container. Preferably, the entire volume of all three containers provides a mixing chamber.

BRIEF DESCRIPTION OF THE DRAWINGS

The invention is shown in more detail referring to certain embodiments according to the drawings FIG. 1 to FIG. 27.

DETAILED DESCRIPTION OF THE DRAWINGS

Figure 1:
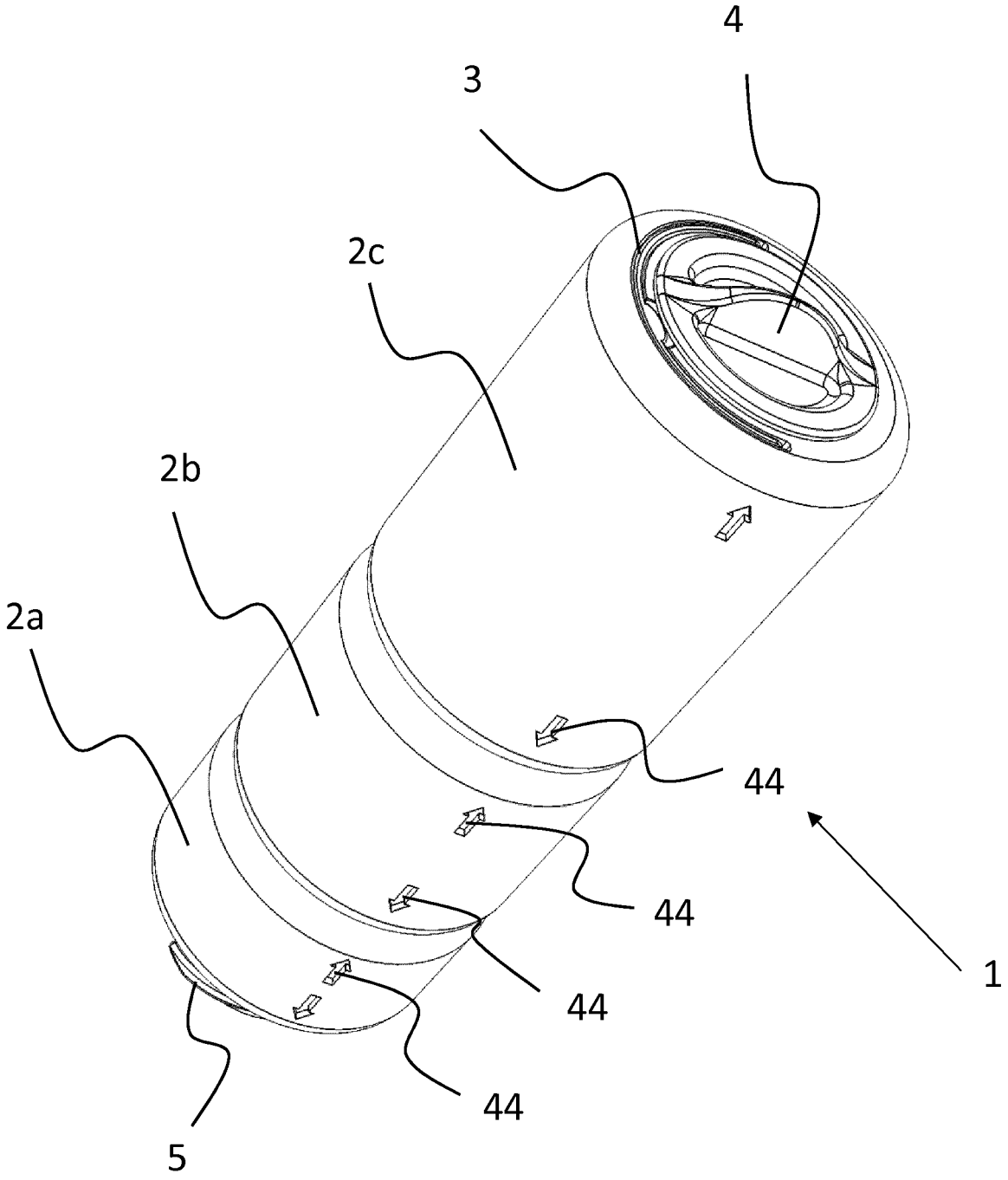
FIG. 1 is a perspective view of a mixing system according to an embodiment of the invention.

FIG. 1 is a perspective view of an embodiment of a mixing system 1 according to the invention.

In this embodiment, the mixing system 1 comprises the three containers 2*a*-2*c*.

As an example each of these containers 2*a*-2*c* has a different size in comparison to the other containers 2*a*-2*c*.

In this embodiment, the containers 2*a*-2*c* have a cylindrical shape and are connected in series. Preferably, the housings of the containers 2*a*-2*c* have a diameter between 5 and 10 cm. Each container preferably has an inner volume between 50 and 500 ml.

The containers 2*a*-2*c* consist of a plastic material, preferably of a polypropylene.

According to an embodiment of the invention, the containers 2*a*-2*c* comprise, for instance are coated with, an oxygen-barrier coating, e.g. a deposited glass or metal layer or an EVOH-layer.

The housing of the containers 2*a*-2*c* can comprise an integrally molded batch number and/or label (not shown).

The sidewall of the containers 2*a*-2*c* comprise markings 44 (embodied as arrows). As shown, the markings of the respective containers 2*a*-2*c* are positioned on one line. In this condition, the containers 2*a*-2*c* are non-twistably locked. There is already formed a channel 23 between the containers 2*a*-2*c*, which enables the passage of liquid.

The topmost container 2*c* comprises a hanger 3 to attach the mixing system 1 to an infusion rack (not shown).

In this embodiment, the hanger 3 is a component of the topmost container 2*c*.

The undermost container 2*a* comprises the free or non-connected male connector 5 of the mixing system 1. The male connector 5 of this container 2*a* provides an exposed septum 32 into which a spike or needle can be inserted.

The female connector 6 of the topmost container 2*c* is here additionally equipped or loaded with a cartridge 4, which can comprise a solid ingredient, e.g. a pharmaceutical powder.

Figure 2:
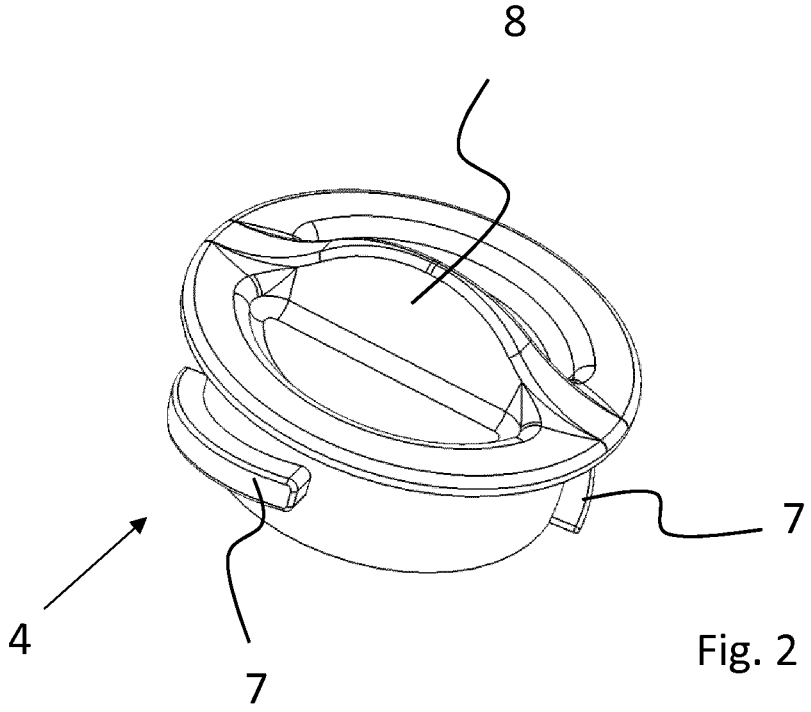
FIG. 2 and FIG. 3 are perspective views of a cartridge, which comprises a powder, e.g. a pharmaceutical powder or a micro nutrition, which can be used for the mixing system.
Figure 3:
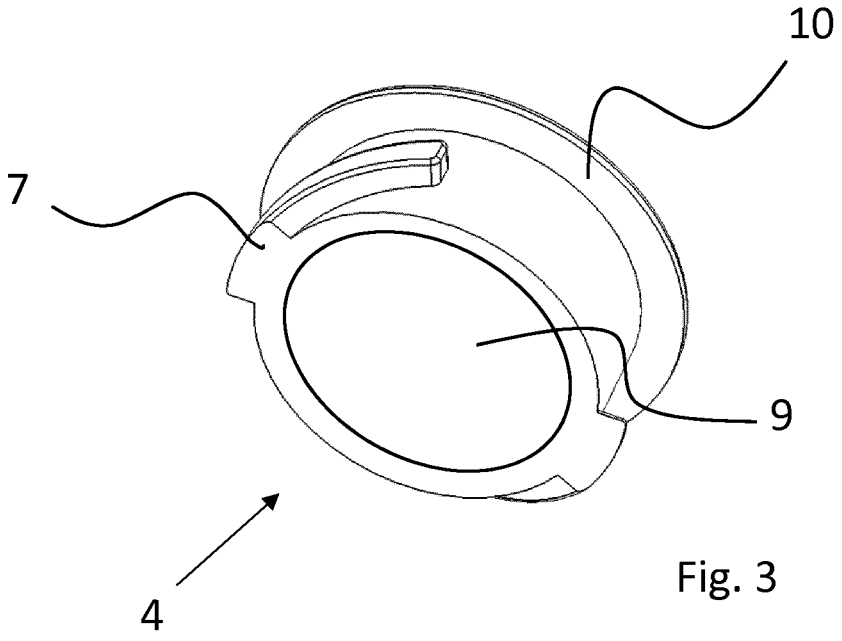

FIG. 2 and FIG. 3 are perspective views of the cartridge 4.

The cartridge 4 is preferably embodied as a molded plastic part.

As shown in FIG. 2, the cartridge 4 comprises a thread 7 and a grip 8 which can be used to screw the cartridge 4 into a female connector 6, here into the female connector 6 of the topmost container 2*c*.

The thread 7 comprises two segments, which are arranged on opposite sidewalls of the cartridge 4. The segments of the thread 7 can be inserted into corresponding notches 11 of the female connector 6. The cartridge 4 can be connected with the female connector 6 of the topmost container 2*c*, preferably by turning the cartridge 4 less than one turn, most preferably by turning a half turn or less (see for instance FIG. 4).

As shown in FIG. 3, the cartridge 4 comprises a collar 10 at its upper side.

The bottom side of the cartridge 4 comprises a membrane 9, which preferably opens automatically, when connecting the cartridge 4 to the female connector 6. Thereby, the pharmaceutical ingredient (not shown) can enter into the respective container 2, 2*a*-2*d*, and can be mixed with the liquid ingredient of at least one further container 2, 2*a*-2*c*.

Figure 4:
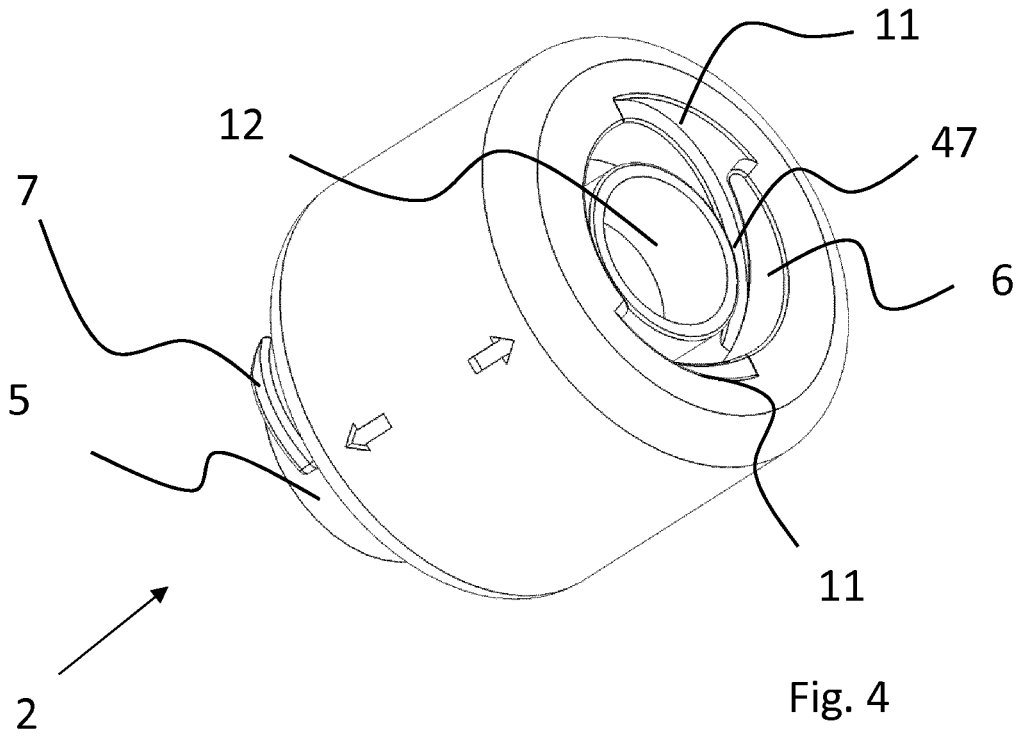
FIG. 4 and FIG. 5 are perspective views of one container of the mixing system.
Figure 5:
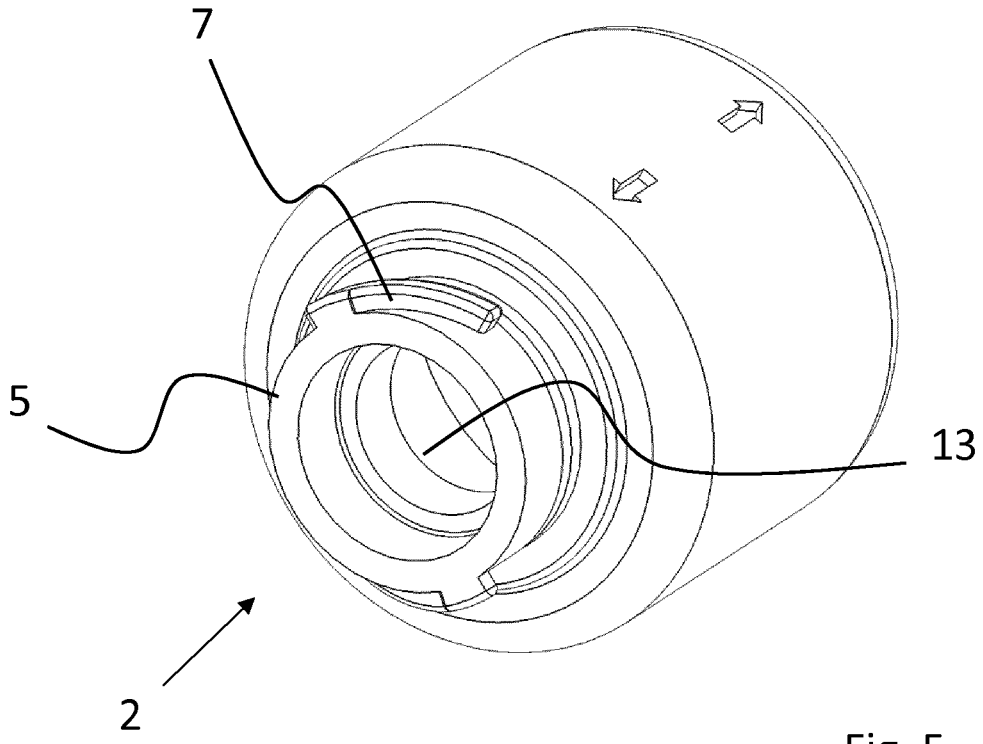

FIG. 4 and FIG. 5 are perspectives views of a container 2, which is or can be one component of the mixing system 1 shown in FIG. 1.

At opposite ends the container 2 comprises a male connector 5 and a female connector 6. The female connector 6 comprises at least two notches 11. The notches 11 are embodied to receive the at least two segments of the thread 7 of the male connector 5 of another container 2, 2*a*-2*d*.

The male connector 5 and female connector 6 of the container 2, and of the further containers 2*a*-2*d* of the mixing system 1 fit together. Therefore, the containers 2, 2*a*-2*d*, can be connected in various orders.

The male 5 and/or female connector 6 is/are preferably integrally molded. According to another embodiment, the male connector 5 and the female connector 6 can also be welded or glued to the housing.

The containers 2*a*-2*d* filled with a liquid for parenteral nutrition are preferably produced in an aseptic blow-fill-seal process. Alternatively, also a stretch-blow-mold process can be used.

The notches 11 turn into a female thread 47, which is suitable for engaging the thread 7 of the male connector 5. To connect a container 2, 2*a*-2*d* to another container 2, 2*a*-2*d*, the male connector 5 is inserted into the female connector 6 by an axial movement. The segments of the thread 7 engage into the notches 11. Then, the containers 2, 2*a*-2*d* are twisted and the segments of the thread 7 are engaged in the corresponding segments of the female thread 47.

Preferably, the containers 2, 2*a*-2*d* are twisted by less than a half turn, in particular preferred by approximately a quarter turn, in order to engage a non-detachable and/or locked connection.

Figure 13:
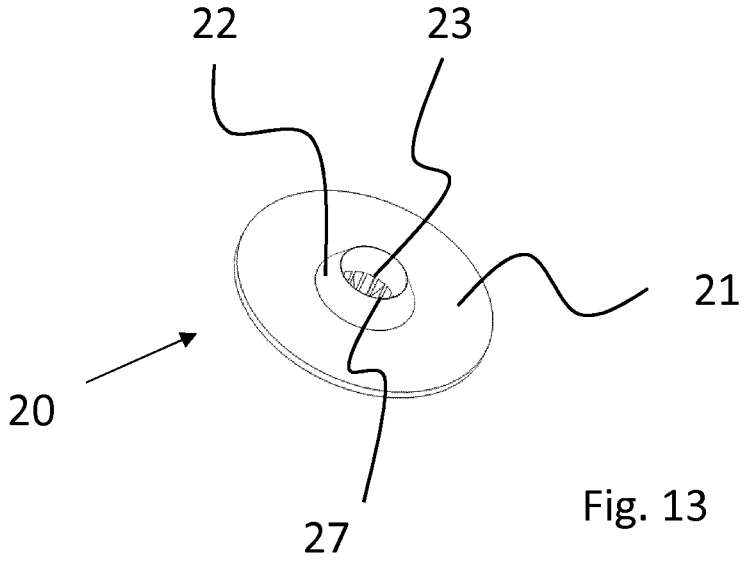
FIG. 13 and FIG. 14 are perspective views of the membrane breaker insert.
Figure 14:
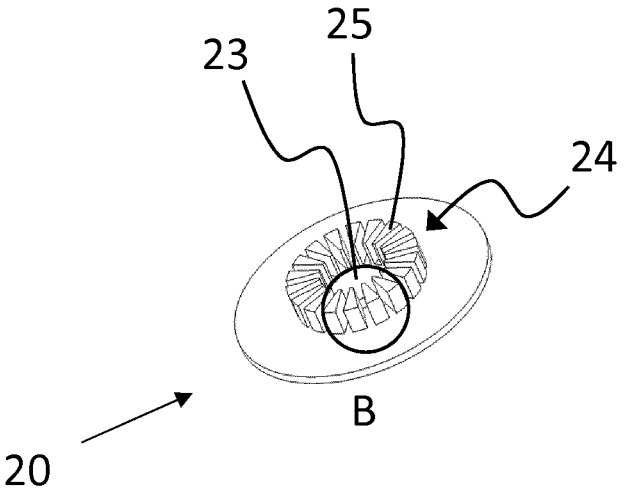
Figure 14A:
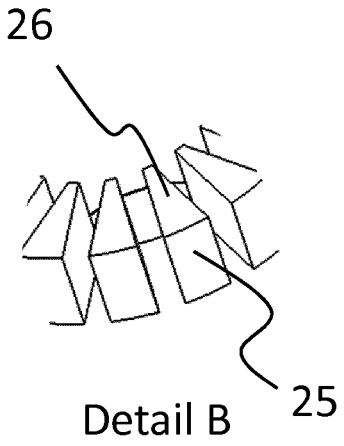
FIG. 14*a* is a detailed view of FIG. 14

The female connector 6, as well as the male connector 5, comprise a duct 12, 13, which enables the passage of liquid, when the containers 2, 2*a*-2*d* are fully connected (e.g. via the channel 23 of the membrane breaker insert 20, shown in FIG. 13-14*a*).

Figure 6:
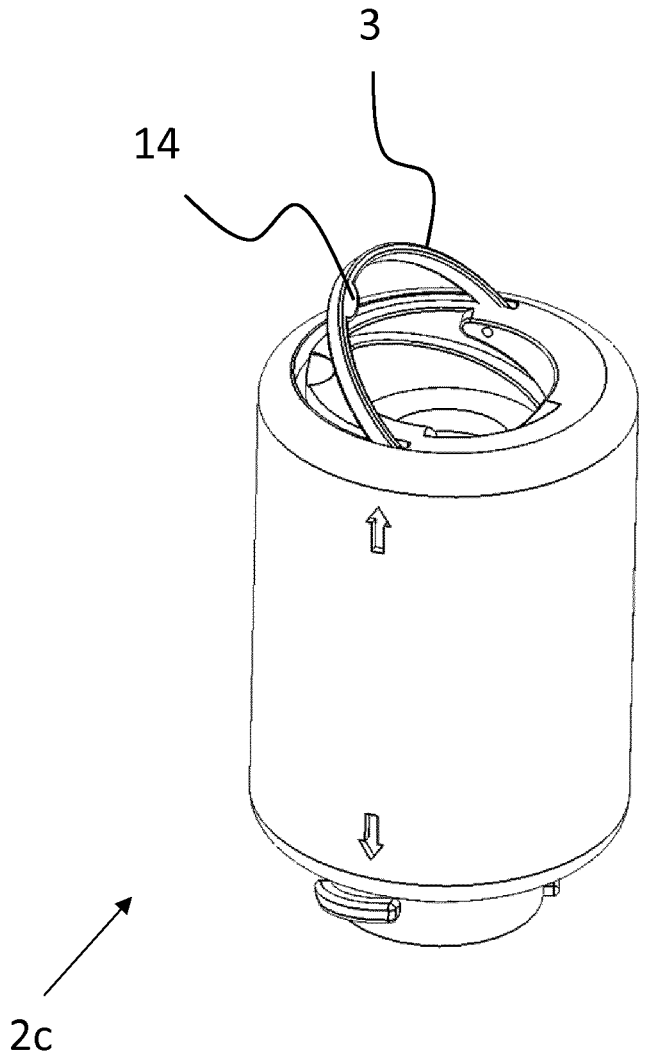
FIG. 6 shows a further container of the mixing system, which comprises a hanger.

FIG. 6 is a perspective view of the uppermost container 2*c* of the mixing system 1 shown in FIG. 1.

The uppermost container 2*c* comprises a hanger 3.

The hanger 3 is hinged and can be flapped out by pulling at the lug 14. If the hanger 3 is in a retracted position, the hanger 3 is, according to an embodiment of the invention, snapped in.

In this embodiment, the hanger 3 is a fixed component of the container 2*c*.

According to an embodiment of the invention (not shown), each of the containers 2*a*-2*c* of the mixing system 1 comprises such a hanger 3, so that each of the containers 2*a*-2*c* can be used as the uppermost container 2*c*.

According to another embodiment of the invention (not shown), the hanger 3 is a separate element of the mixing system 2. The hanger 3 can be part of a separate component, which can be connected with a female connector 6 of the topmost container 2*c* of the mixing system 1.

Figure 7:
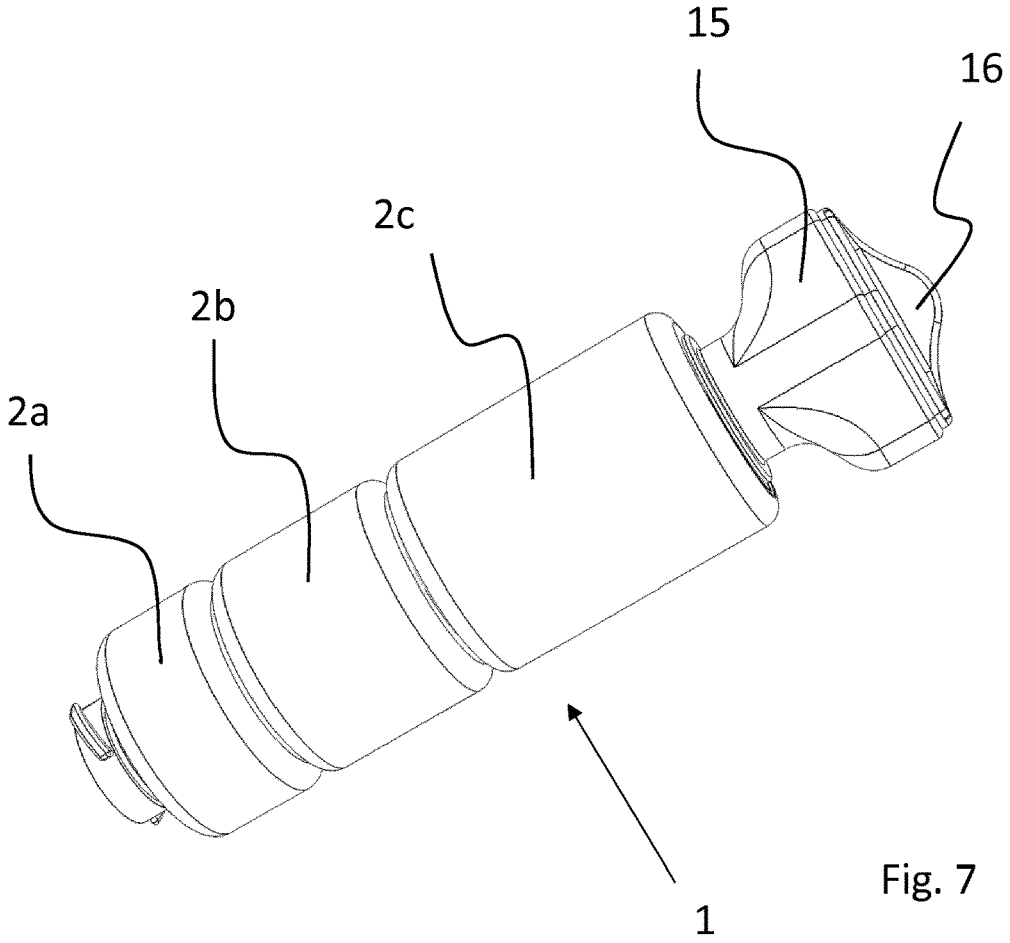
FIG. 7 is a perspective view of a mixing system, which is equipped with a vial holder.
Figure 8:
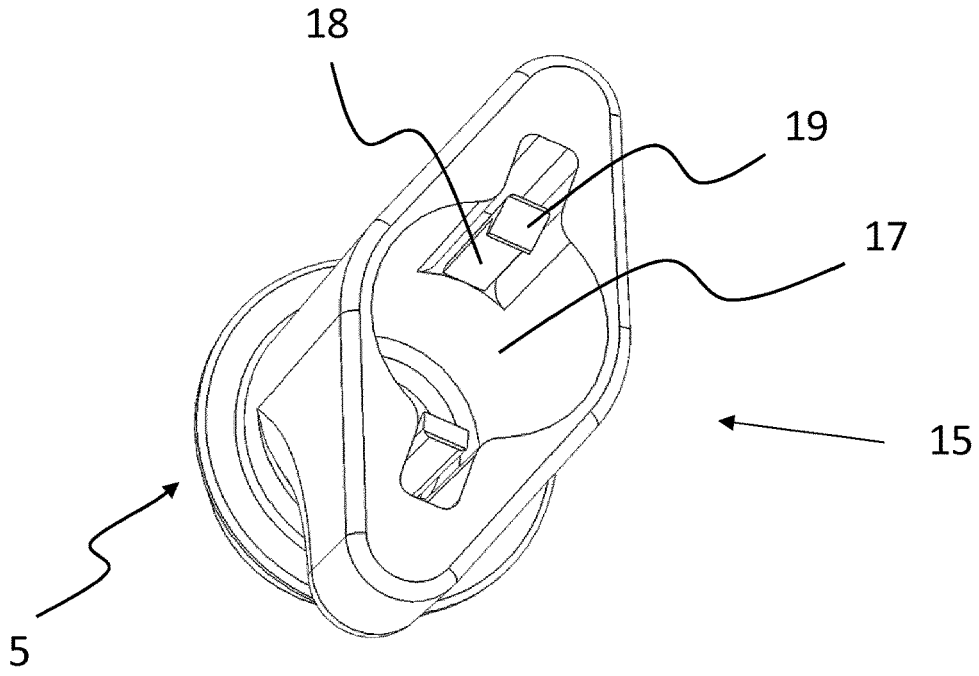
FIG. 8 is a perspective view of the vial holder.

In particular, the hanger 3 can be connected also to a cartridge 4 (as e.g. shown in FIG. 2 and FIG. 3) or to a vial or ampoule holder 15 (as shown in FIG. 7 and FIG. 8).

FIG. 7 is a perspective view of a mixing system 1, which comprises three containers 2*a*-2*c* connected to each other (corresponding to the mixing system 1 shown in FIG. 1).

The mixing system 1, shown in FIG. 7, comprises a vial holder 15 (instead of a cartridge 4), which is connected to the female connector 6 of the uppermost container 2*c*.

The vial holder 15 comprises a cover 16 with a grip. The cover 16 can be removed in order to insert an ampoule or a vial (not shown).

FIG. 8 is a detail perspective view of the vial holder 15, wherein the cover 16 is removed.

The vial holder 15 comprises a male connector 5 for connecting the vial holder 15 to a female connector 6 of a container 2, 2*a*-2*d*.

The male connector 5 of the vial holder 15 corresponds to the male connector 5 of the containers 2, 2*a*-2*d*.

After removing the cover 16, a vial or an ampoule (not shown) can be inserted into a receiving space 17 of the vial holder 15.

The receiving space 17 is equipped with engagement hooks 19.

The engagement hooks 19 are resiliently supported by bending arms, which axially extend through the vial holder 15 and are adjacent to the receiving space 17.

After fully inserting the vial or ampoule into the receiving space 17, the vial or ampoule is locked in the receiving space by the engagement hooks 19. Preferably, the vial or ampoule is automatically opened in this locked condition, e.g. by opening the vial or ampoule with a piercing element (not shown). The piercing element can be part of the vial holder 15 and/or of the female connector 6 of the container 2, 2*a*-2*d*. If the piercing element is part of the vial holder 15, the vial holder 15 is preferably connected to the female connector 6 before inserting the vial or ampoule into the receiving space 17.

With this vial holder 15 a preferably liquid ingredient, e.g. a preferably liquid pharmaceutical ingredient, can be added to the parenteral nutrition, which is mixed in the mixing system 1.

Figure 9:
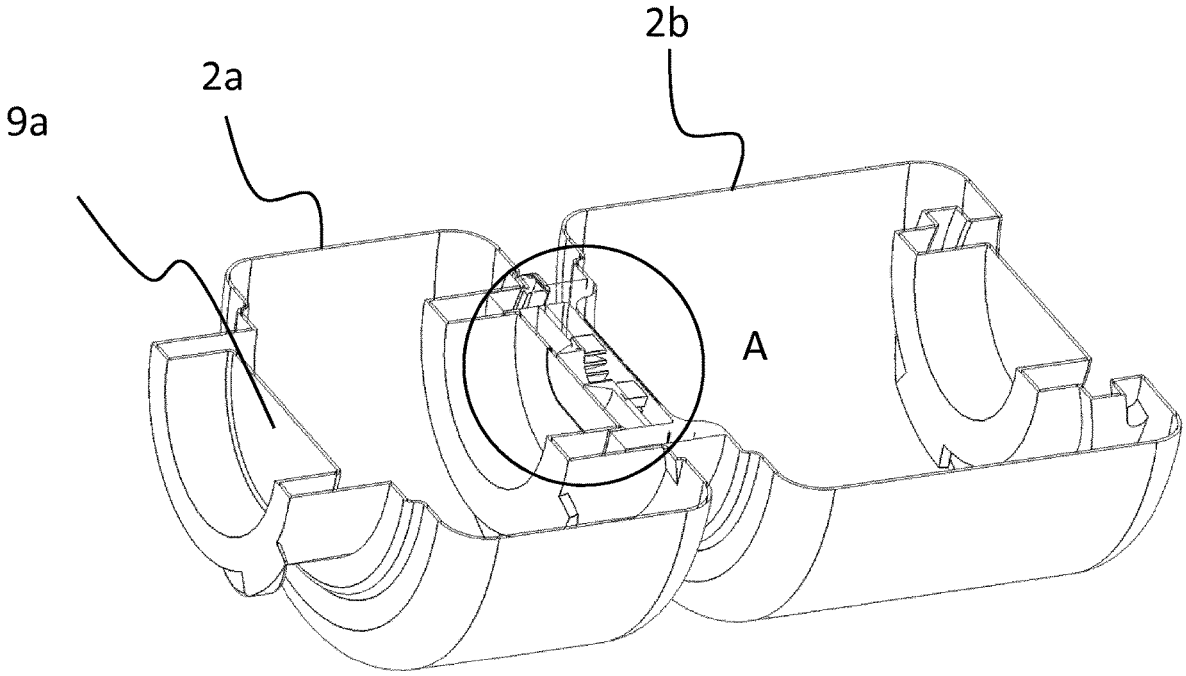
FIG. 9 is a cut-away view of two containers of the mixing system.

FIG. 9 is a perspective cut-away view of two containers 2*a*, 2*b*, which are connected to each other.

The male connector 5 comprises a membrane 9*a* which closes the male connector 5.

Figure 10:
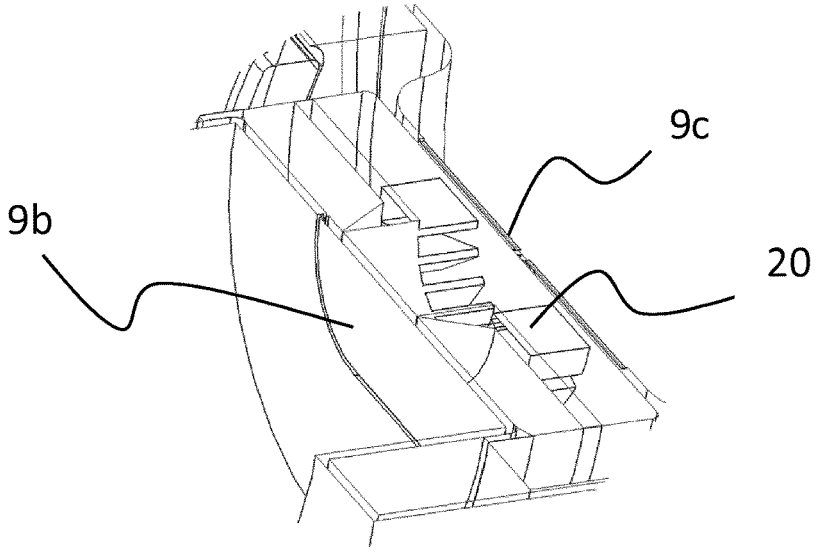
FIG. 10 is a detailed view of FIG. 9 showing the area of a membrane breaker insert.

FIG. 10 is a detailed view of area A of FIG. 9. The female connector 6 of the container 2*a* comprises the membrane 9*b* and the male connector 5 of the container 2*b* comprises the membrane 9*c*.

When the containers 2*a* and 2*b* are completely connected, the membranes 9*b* and 9*c* are automatically opened by a membrane breaker insert 20. Thereby a channel 23 is formed between the containers 2*a* and 2*b*, which enables the passage of liquid. This is shown in detail with reference to the following drawings of FIG. 11 to FIG. 21.

Figure 11:
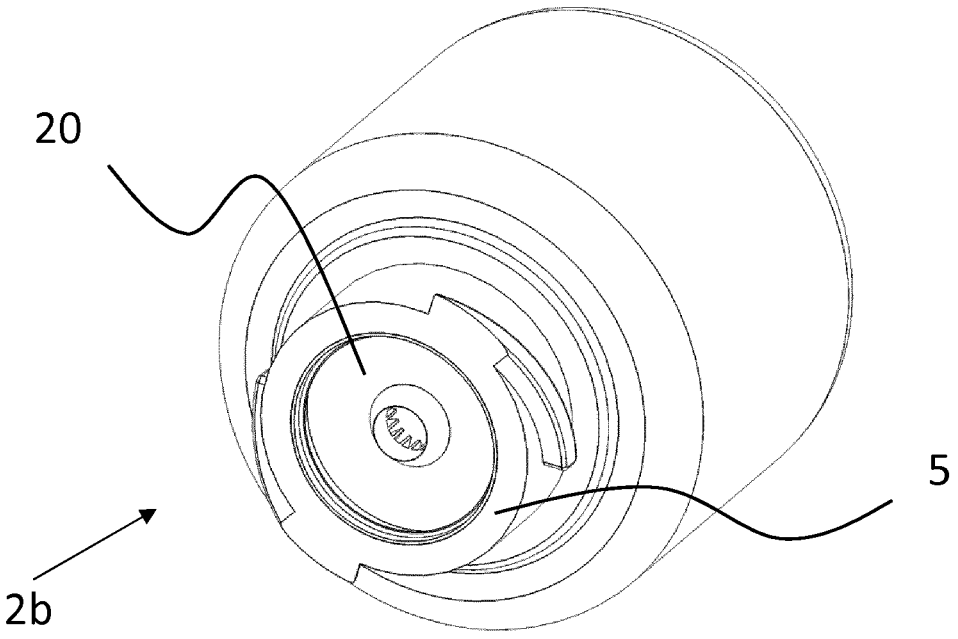
FIG. 11 is a perspective view of a container comprising a membrane breaker insert.

FIG. 11 is a perspective view of the container 2*b*.

In this embodiment, the membrane breaker insert 20 is an integral part of the male connector 5.

The membrane breaker insert 5 is inserted in the duct 13 of the male connector 5.

According to other embodiments of the invention (not shown) the membrane breaker insert can also be an integral component of the female connector 6 or can be provided as a separate component of the mixing system 1.

Figure 12:
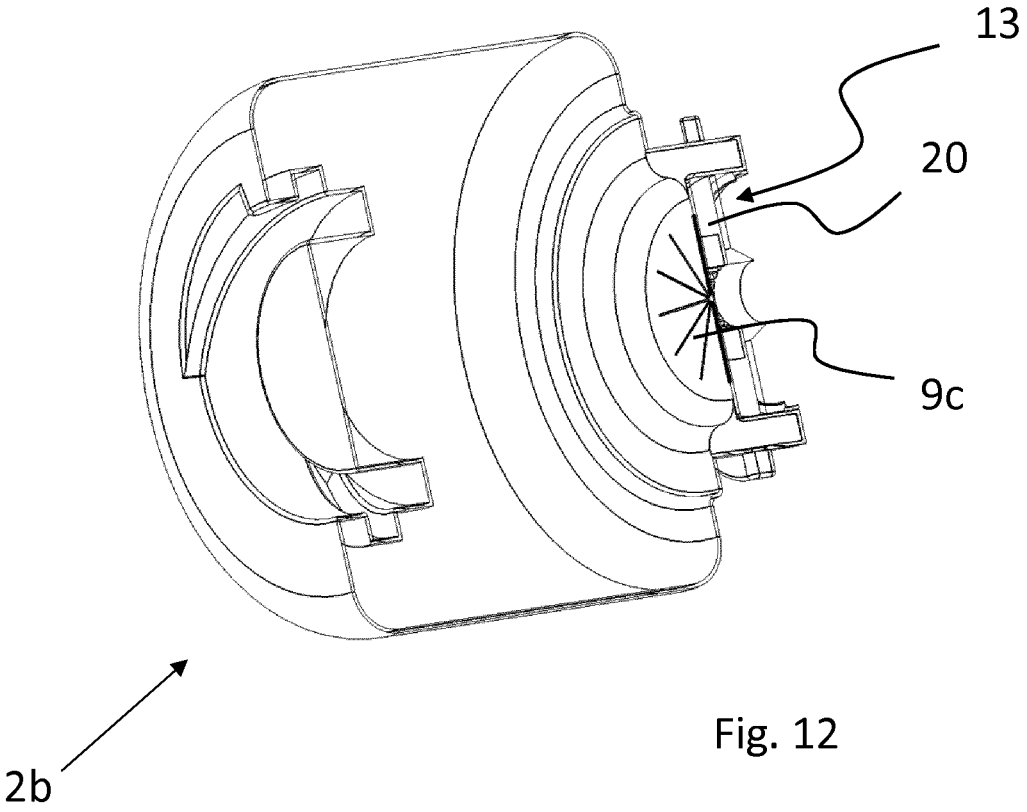
FIG. 12 is a cut-away view of the container.

FIG. 12 is a perspective cut-away view of the container 2*b* showing now the inner part of the membrane 9*c* and the adjacent membrane breaker insert 20.

The membrane breaker insert 20 is inserted in the duct 13 and stays on the membrane 9*c* of the male connector 5.

FIG. 13 and FIG. 14 are perspective views of the membrane breaker insert 20.

As shown in FIG. 13, the membrane breaker insert 20 comprises a discoidal collar 21, which is inserted in the duct 13 of the male connector 5.

In order to enable the passage of liquid, the membrane breaker insert 20 comprises a central channel 23.

On one side of the membrane breaker insert 20 a cone shaped segment 22 surrounds the channel 23. The cone shaped segment 22 forms an edge 27, which is preferably embodied as a sharp edge 27, e.g. a cutting edge 27, which opens the membrane 9*b* of the female connector 6.

FIG. 14 shows the opposite side of the membrane breaker insert 20. On the opposite side of the cone shaped segment 22 the membrane breaker insert 20 comprises a ring 24 of breaker members 25, which are circularly distributed around the channel 23.

FIG. 14*a* is a detailed view of the area B of FIG. 14. The breaker members 25 are essentially wedge-shaped, pointing with their small sides to the central channel 23.

Therefore, the top side 26 of the breaker members 25 is flat, so that the breaker members 25 will not damage the membrane 9*c* during transportation of the container 2, 2*a*-2*d*.

Figure 15:
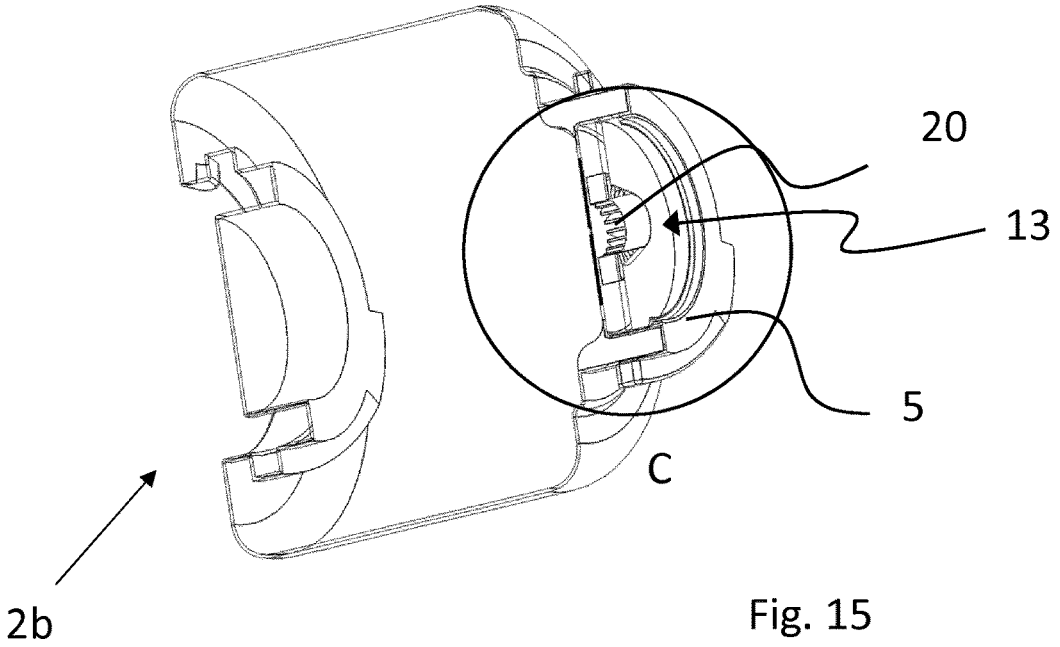
FIG. 15 is a further cut-away view of the container.

FIG. 15 is a further cut-away side view of the container 2*b*, comprising the membrane breaker insert 20 in the male connector 5.

Figure 16:
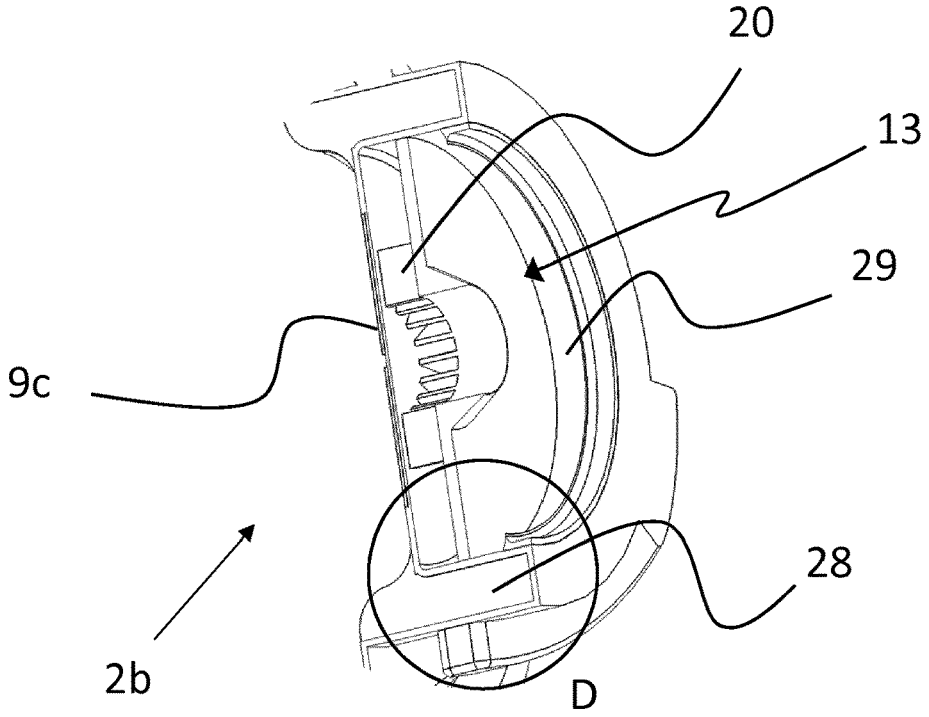
FIG. 16 is a detailed view of the area of the male connector of the container.

FIG. 16 is a detailed view of the area C of FIG. 15.

The membrane breaker insert 20 is inserted into the duct 13 and stays on the membrane 9*c* of the male connector 5.

The male connector 5 further comprises a seal 29, in this embodiment a lip seal, which extends around the inner sidewall 28 of the male connector 5, respectively of the duct 13.

The seal 29 provides a fluid-tight connection of the male connector 5 and the connected female connector 6. The seal 29 is also used to hold the membrane breaker insert 20 in its position.

Figure 17:
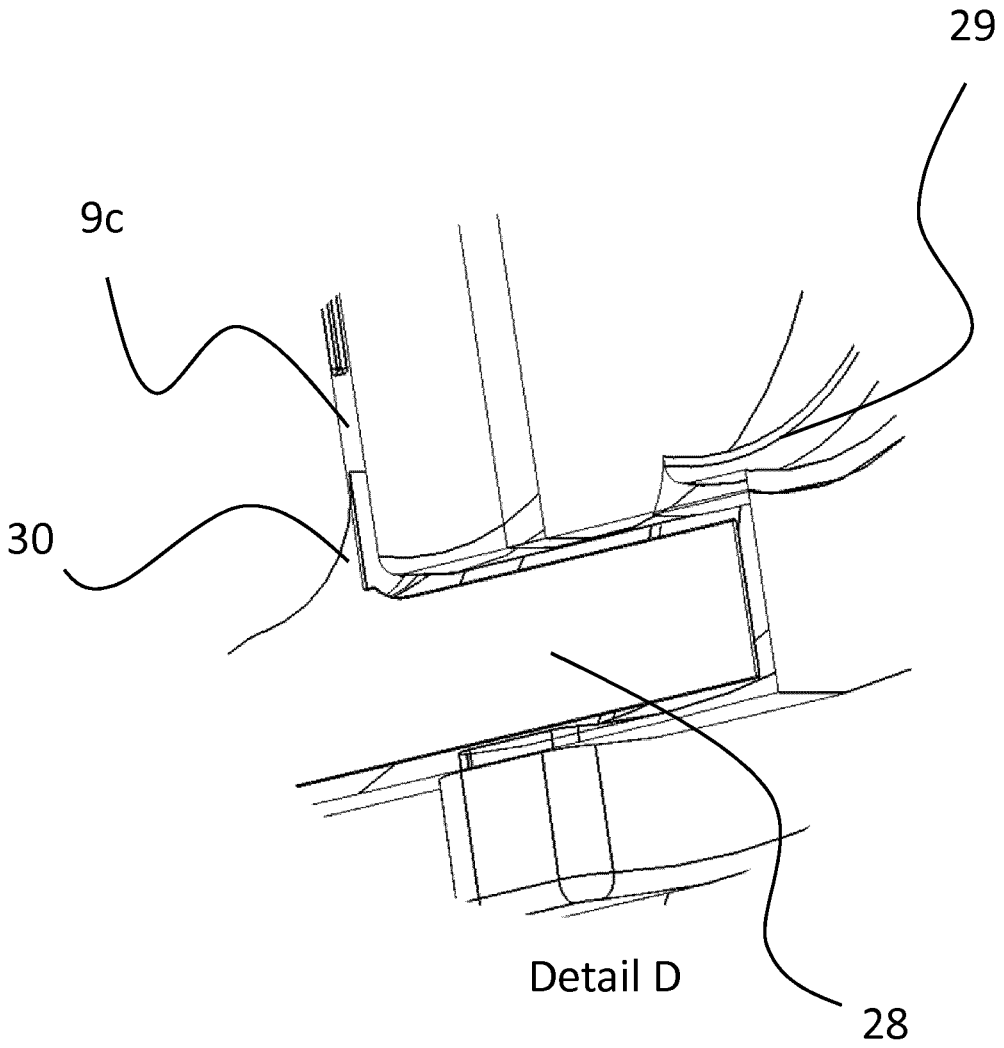
FIG. 17 is a detailed view of FIG. 16 showing the edge of the sidewall of the housing of the container.

FIG. 17 is a detailed view of the area D of FIG. 16.

The sidewall 28 of the male connector 5 comprises an annular projection 30 onto which the membrane 9*c* is applied (e.g. by welding or gluing).

To assemble the container 2*b*, the membrane 9*c* is applied onto the annular projection 30 of the duct 13. Then, the membrane breaker insert 20 is inserted into the duct 13 upon the membrane 9*c*. Hereupon, the seal 29 is inserted into the duct 13. The seal 29 holds the membrane breaker insert 20 in its position, so that the membrane breaker insert 20 is hold between the membrane 9*c*, which is supported by the annular projection 30, and the seal 29.

As mentioned above, the seal 29 further enables a fluid-tight connection immediately when the male connector 5 is inserted into a female connector 5 of another container 2, 2*a*-2*d*.

Figure 18:
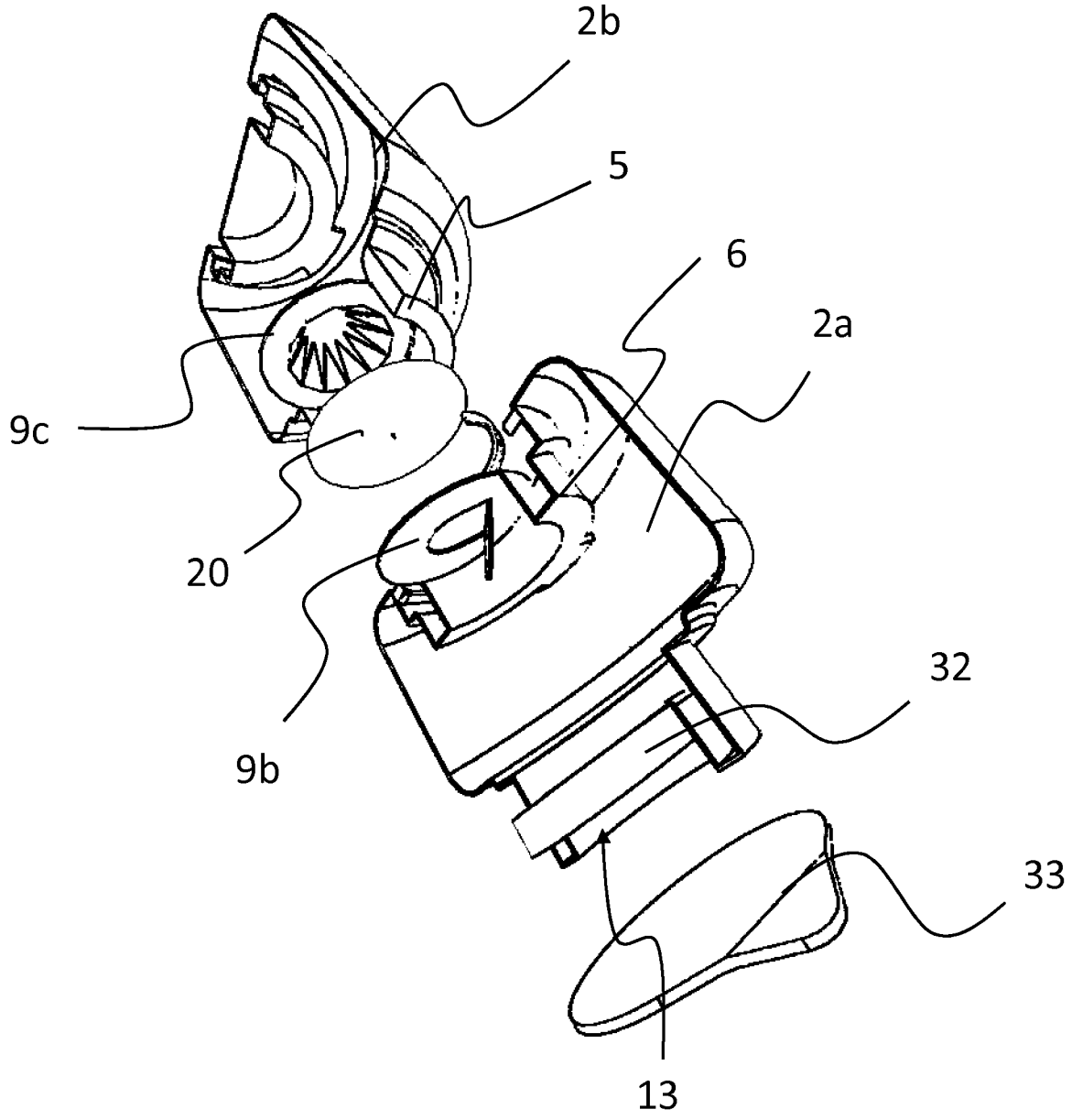
FIG. 18 is an exploded cut-away assembly drawing.

FIG. 18 is an exploded cut-away view of the containers 2*a* and 2*b*, which are going to be connected, thereby forming a channel, which enables the passage of liquid in order to mix the liquid ingredients of the containers 2*a* and 2*b*.

The containers 2*a* and 2*b* are connected by screwing the containers 2*a* and 2*b* together. A channel is formed since the membrane breaker insert 20 opens the membrane 9*c* of the male connector 5 of container 2*b* as well as the membrane 9*b* of the female connector 6 of container 2*a*. Fluid can flow through the channel 23 of the membrane breaker insert 20.

The connection of the containers 2*a* and 2*b* is preferably performed in two steps.

Figures 23, 24:
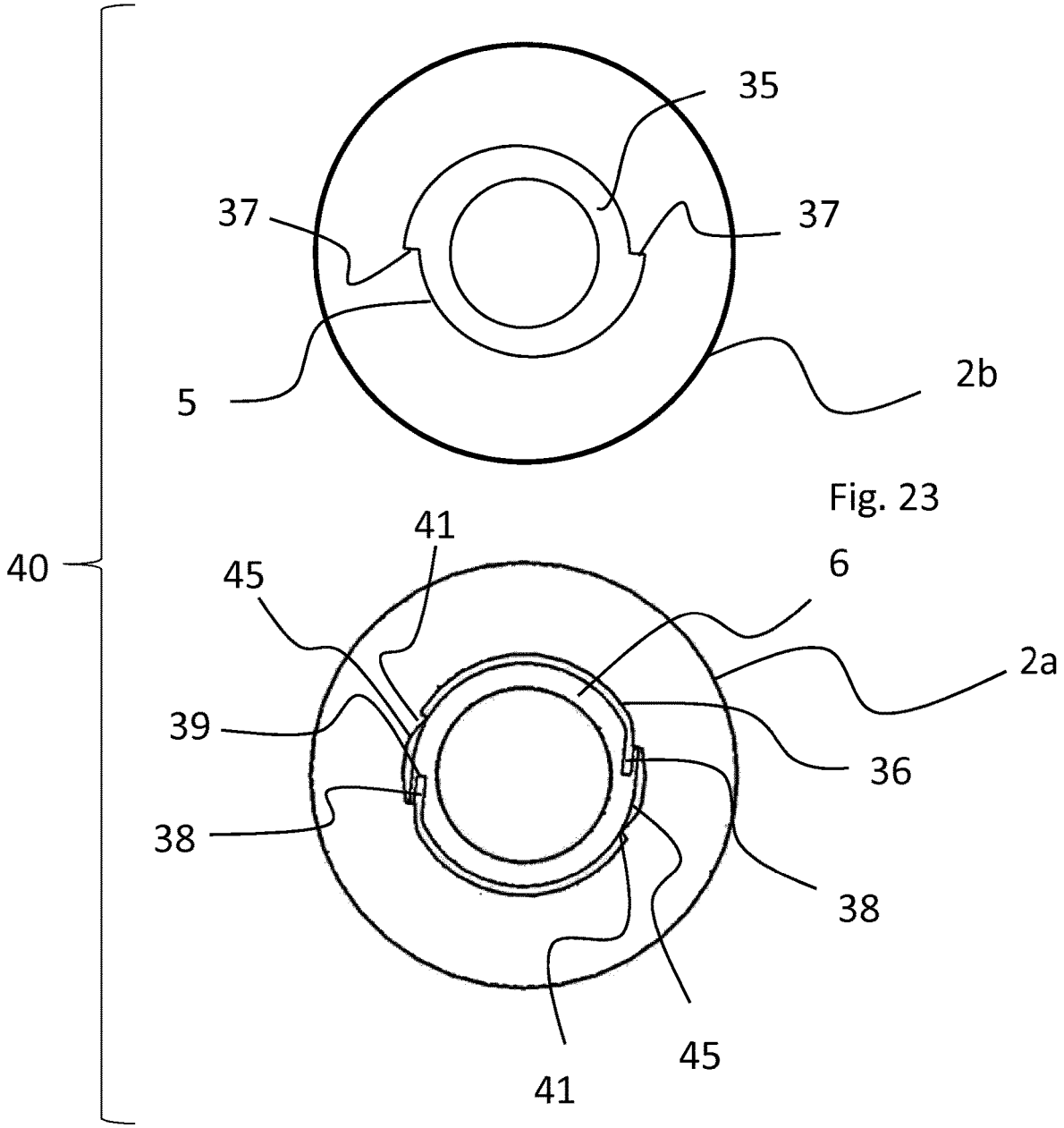
FIG. 23 and FIG. 24 show the components of a locking devise, according to an embodiment of the invention.

For this purpose, the male and/or the female connector 5, 6 may comprise a locking device 40, e.g. a locking device 40 as shown in FIG. 23 and FIG. 24.

The general concept of such a two-step-process could be as described as following:

In a first step, the containers 2*a* and 2*b* are twisted against each other and thereby connected. When twisting the containers 2*a*, 2*b*, the locking device 40 snaps into a first position. In this first position, the containers 2*a*, 2*b* cannot be twisted in the reverse direction. The containers 2*a*, 2*b* are mechanically connected in this first state and preferably form a fluid-tight sterile connection due to the seal 29.

However, membranes 9*b* and 9*c* are not yet opened. There is still no channel, which would enable the passage of liquids.

By performing this first step, a preassembled mixing system 1 is provided.

By further twisting the containers 2*a* and 2*b* against each other in second step, the locking device 40 snaps into a second position. In this second state the membranes 9*b* and 9*c* are opened and the liquid contents of the containers 2*a*, 2*b* can be mixed. Preferably this second twisting requires a higher torque.

In the embodiment shown in FIG. 18 the male connector 5 of the container 2*a* comprises a septum 32, which is inserted into the duct 13 and which is pierceable by a spike or by a needle in order to deliver the mixed parenteral nutrition to the patient.

The spike or the needle can be vented component. According to another embodiment of the invention, at least one container of the mixing system is or can be vented, so that also a non-vented spike or needle can be used.

The male connector 5 further comprises, in this embodiment, a tamper-evident seal 33. The tamper-evident seal 33 e.g. can be embodied as a foil 33, which is applied onto the end face of the male connector 5.

To connect the male connector 5 of the container 2*a* to another container or to expose the septum 32 of the container 2*a*, the foil 33 can be peeled off.

The female connector 6 can also comprise a tamper-evident seal (not shown).

Figure 19:
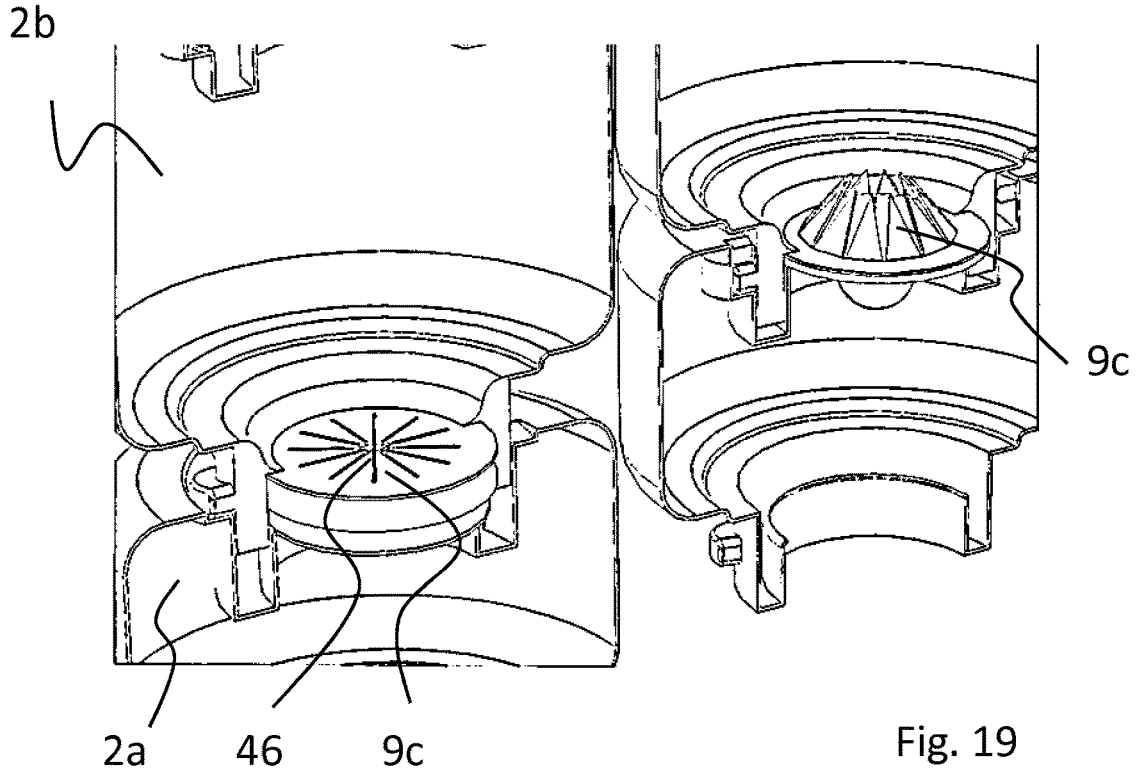
FIG. 19 and FIG. 20 are further cut-away views of two containers, which illustrate that a channel, which enables the passage a liquid, is formed, when the containers are connected.
Figure 20:
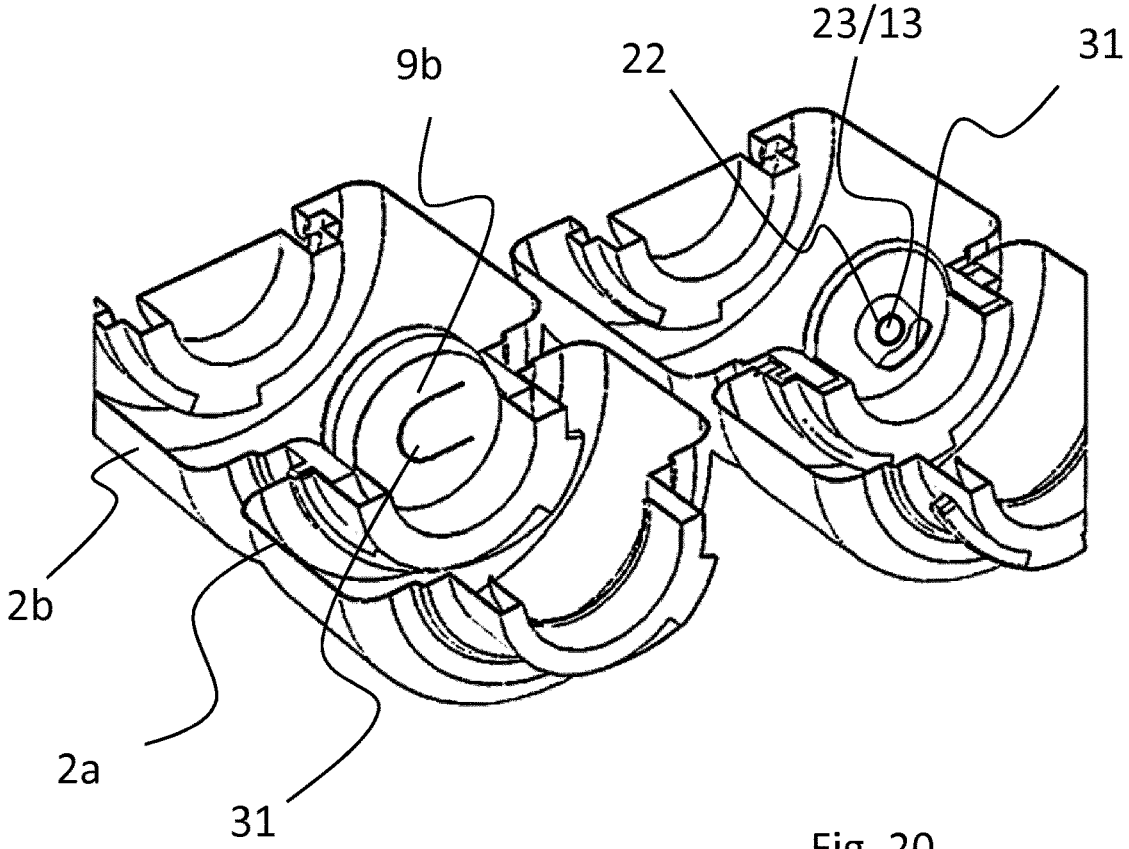
Figure 21:
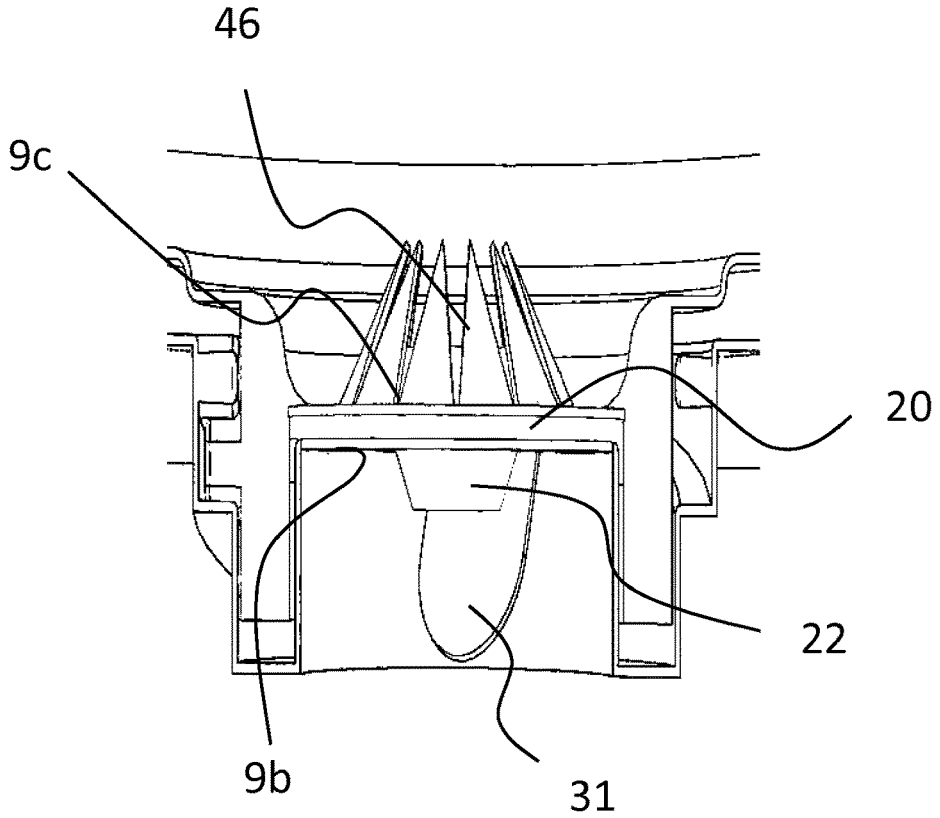
FIG. 21 is a cut-away view showing the open channel between the containers.

With reference to FIG. 19-FIG. 21, it is shown in detail, how the membranes 9*b* and 9*c* are opened by the membrane breaker insert 20, when twisting the containers 2, 2*a*-2*d* against each other.

FIG. 19 is a detailed perspective of a cut-away view of the area of the male connector 5 of container 2*b* and of the female connector 6 of container 2*a*. At the left view, the containers 2*a* and 2*b* are mechanically connected, but the containers 2*a* and 2*b* are not twisted as much as it is necessary to open the membrane 9*c* of the male connector 5. The two containers 2*a* and 2*b* are in a first connection state. The membrane 9*c* of the male connector 5 comprises, in this embodiment, a star-shaped precut 46.

The right view of FIG. 19 illustrates the two containers 2*a* and 2*b* in their final second connection state. When further twisting the containers 2*a*, 2*b* against each other, the star-shaped precut 46 of the membrane in 9*c* is opened by the ring 25 of breaker members 24 (see FIG. 14). By screwing the containers 2*a* and 2*b* together, the ring 25 of breaker members 24 is pressed onto the adjacent surface of the membrane 9*c*, thereby slicing the star-shaped pre-cut 46, as a result the membrane 9*c* is opened.

FIG. 20 is a further cut-away view of the containers 2*a* and 2*b*, showing now the membrane 9*b* of the female connector 6. The left view shows the two containers 2*a* and 2*b* in the first connection state. The right view shows the two containers 2*a* and 2*b* in the final second connection state.

As shown in the left view, the membrane 9*b* of the female connector 6 comprises a pre-cut 31. The pre-cut 31 is exemplary shown as a U-shaped pre-cut 31.

As shown in the right view, the U-shaped pre-cut 31 is opened by the cone shaped segment 22 of the membrane breaker insert 20.

Now, a duct 13 is established or open, which enables the passage of liquid between the containers 2*a* and 2*b* trough the channel 23 of the membrane breaker insert 20.

The size of the channel 23 is large enough to enable the mixing of the liquid content of connected containers 2, 2*a*-2*d* by agitating the containers 2, 2*a*-2*d*.

FIG. 21 is a detailed cut-away view of the area of the membrane breaker insert 20 showing the male connector 5 of the container 2*b* and the female connector 6 of the container 2*a* in the final second connection state. The pre-cut 31 of the membrane 9*d* of the female connector 6 is opened by the cone shaped segment 22 of the membrane breaker insert 20. The pre-cut 46 of the membrane 9*c* is opened by the ring 25 of breaker members 24 of the membrane breaker insert 20.

Figure 22:
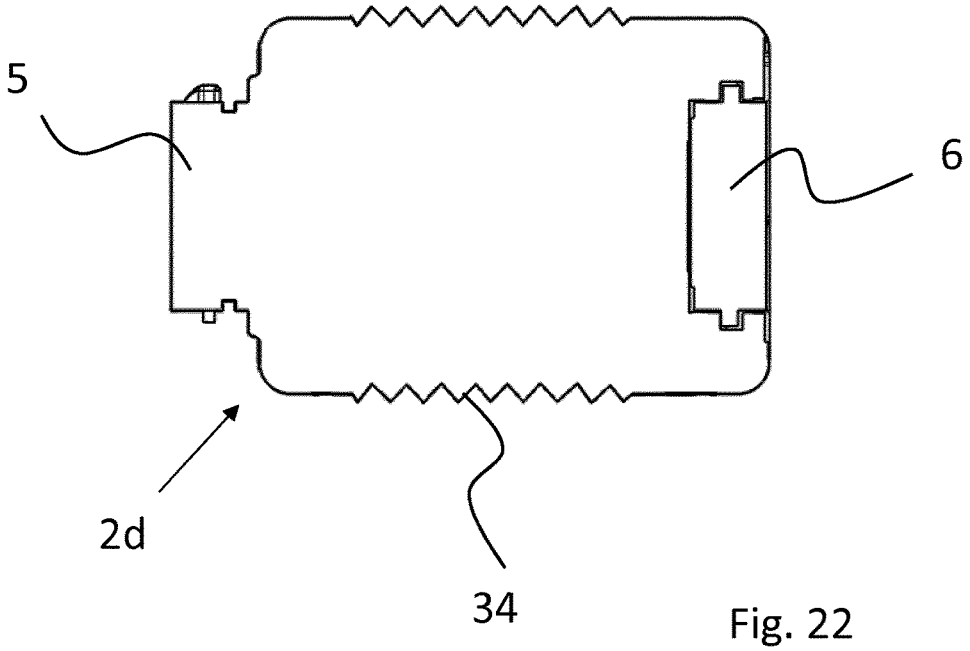
FIG. 22 is a sectional view of a further embodiment of a container, which is embodied as a bellows.

FIG. 22 is a sectional view of a further embodiment of a container 2*d*, which can be one component of the mixing system 1.

The container 2*d* also comprises a male connector 5 and a female connector 6 at both opposite sides of its housing. The connectors 5 and 6 can be embodied as described above.

In this embodiment, the container 2*d* is embodied, at least in parts, as a bellows 34.

This embodiment of the container 2*d* can be used, for example, as an expandable component of the mixing system 1 in order to provide an additional mixing volume by expanding the container 2*d*.

In addition, the container 2*d* can be used as a pump. In particular, the mixing system 1 can comprise two containers 2*d*, which are embodied as bellows 34. In this embodiment, the liquid content in the mixing volume, which consists of the entire volume of all connected containers 2, 2*a*-2*d*, can be mixed by using at least one of the containers 2*d* (embodied as a bellows) as a pump, thereby using the other container 2*d* (being embodied as a bellows) as a buffer volume. By expanding and/or compressing the bellows a pumping action can be generated.

FIG. 23 and FIG. 24 are schematic drawings of a locking device 40 used to connect the containers 2*a* and 2*b* in two steps. FIG. 23 shows a front view on the male connector 5 of container 2*b*.

FIG. 24 is a front view on the female connector 6 of container 2*a*.

The locking device 40 consists of an outer member 36 and an inner member 35.

The inner member 35 is preferably part of a male connector 5 (see FIG. 23). The inner member 35 has a ring-shaped structure, wherein the thickness of the ring increases in thread direction. The inner member 35 has at least one, preferably two steps 37 from the smallest to the largest diameter of the structure. The steps 37 are essentially aligned in a radial direction. The inner member 35 can be placed, for example, above the thread 7 of a male connector 5 (not shown).

As shown in FIG. 24, the female connector 6 comprises an outer member 36, which can be placed, for example, below or in the area of the notches 11 of the female connector 6. In the shown embodiment two outer members 36 are provided.

Preferably each of the outer members 36 comprises at least one resilient end section 38 comprising the edge 39 of the outer member 36.

When engaging the inner member 35 and the outer member 36 by twisting the containers 2*a* and 2*b* against each other, the steps 37 of the inner member 35 force the resilient end sections 38 of the outer member 36 to spread outwardly.

Then, the steps 37 of the inner member 35 pass the edges 39 of the outer member 36. The resilient end sections 38 then snap in, so that the containers 2*a* and 2*b* cannot be twisted in the reverse direction anymore.

There is now established a non-detachable connection between the containers 2*a* and 2*b* in order to provide a pre-assembled mixing system 1. The two containers 2*a* and 2*b* are in a first connection state.

Preferably, the resilient end sections 38 generate an acoustically perceptible "click" when snapping in. With this sound it is signaled to the user, that the containers 2*a* and 2*b* are non-detachably connected.

In a second step, in order to generate a channel which enables the passage of liquid, the user continues twisting the containers 2*a* and 2*b*, preferably with more torque. In particular, a resistance has to be overcome when twisting the containers 2*a*, 2*b* to a final connected position.

Now, the resilient sections 45, which follow the resilient end section 38, are forced outwardly. In a final position, the edge 41 snaps in behind the step 37.

Preferably, thereby a second "click" is generated, signaling that now a connection, which enables the passage of liquid has been established, so the user can mix the ingredients, e. g. by agitating.

Now, the containers 2*a* and 2*b* are non-twistably connected. The final second connection state of the two containers 2*a* and 2*b* is reached. The markings 44 of the containers 2*a* and 2*b* are in the position shown in FIG. 1.

Figure 25:
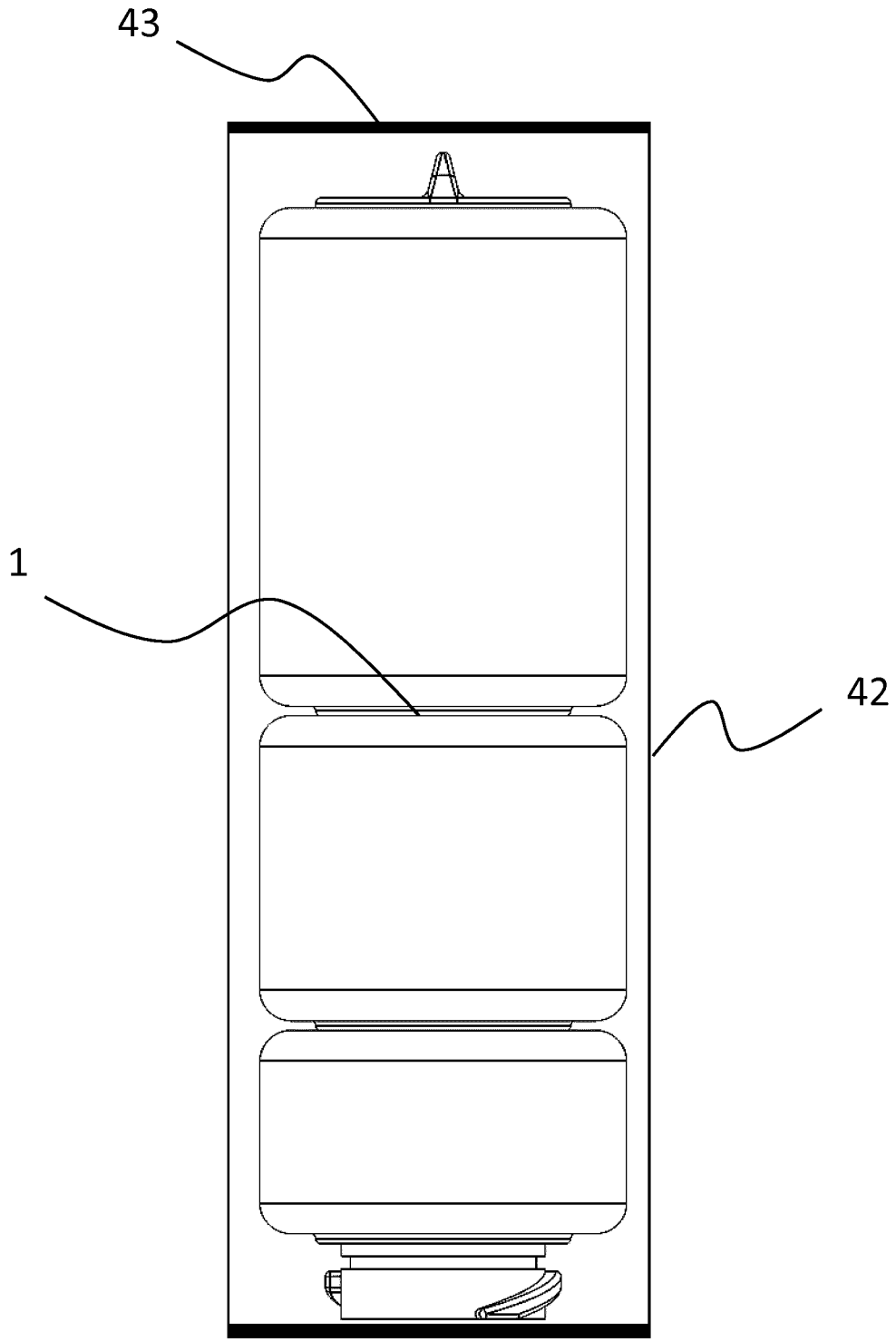
FIG. 25 is a schematic drawing of a preassembled mixing system, which is arranged in a secondary package.

FIG. 25 is a schematic view of a preassembled mixing system 1, which comprises a secondary package 42.

The mixing system 1 as shown in FIG. 1 is preassembled, e.g. by engaging a non-detachable connection of the containers 2, 2*a*-2*d* of the mixing system 1. The containers 2, 2*a*-2*d* are in their first connection state.

Then, the containers 2, 2*a*-2*d* are inserted into a secondary package 42, which has preferably an oxygen-diffusion barrier, in particular which has an oxygen-tight coating, e.g. a metal coating.

In this embodiment, the secondary package 42 is embodied as a tube, for instance as a cylindrical-shaped package, which comprises a lid 43, which can be lifted off by the user.

Preferably, the leaflet (not shown) of the preassembled mixing system 1 is inserted into the secondary package 42. Therefore, the preassembled mixing system 1 can be easily equipped with various country-specific leaflets.

Figure 26:
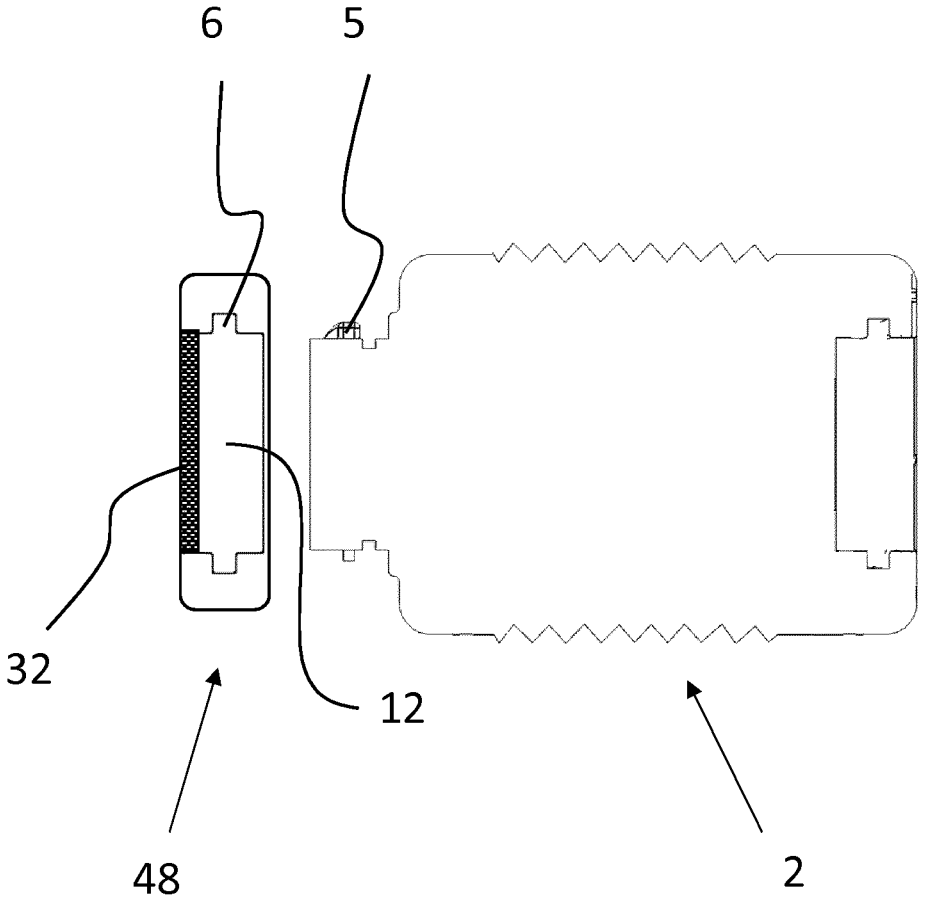
FIG. 26 is a sectional view of a container, which is equipped with a modular septum.

FIG. 26 shows an embodiment of mixing systems 1, wherein the septum 32 for inserting a spike or a needle is embodied as a separate modular component 48.

The septum module 48 comprises a female connector 6, which can be connected to a male connector 5 of a container 2. Further, a septum 32, which is pierceable by a spike or a needle, is placed in the duct 12 of module 48.

The septum module 48 can be connected to a lowermost container (e.g. container 2*a* in FIG. 1) of a mixing system 1.

Preferably, the female connector 6 of the septum module 48 also comprises a membrane breaker insert 20 as described with reference to FIG. 9-FIG. 22 (not shown). Accordingly, when connecting the septum module 48 to a container, 2, 2*a*-2*d*, the male connector 5 of the container 2, 2*a*-2*d* is automatically opened by slicing a membrane 9*c* of the male connector 5.

Figure 26A:
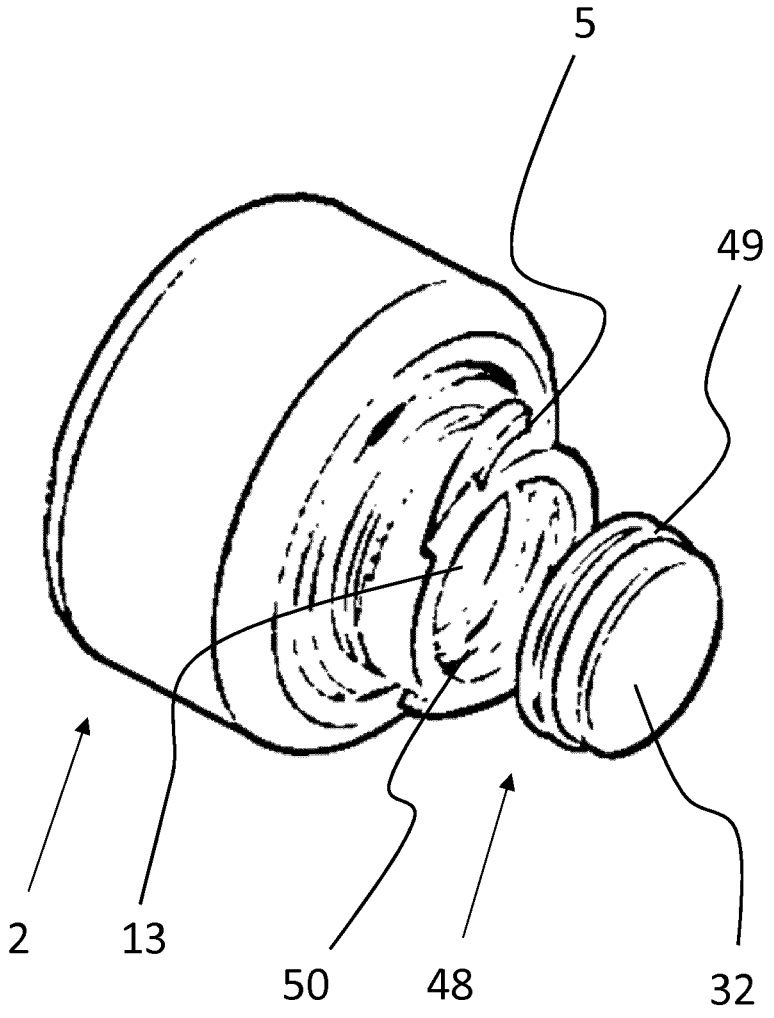
FIG. 26*a* is a perspective view of a container, which is equipped with a modular septum.

FIG. 26*a* is a perspective view of a container, which is equipped with a modular septum 48 of different design. This modular septum 48 is adapted to be screwed into the male connector 5 of the lowermost container 2 (e.g. container 2*a* in FIG. 1) of a mixing system 1

Figure 27:
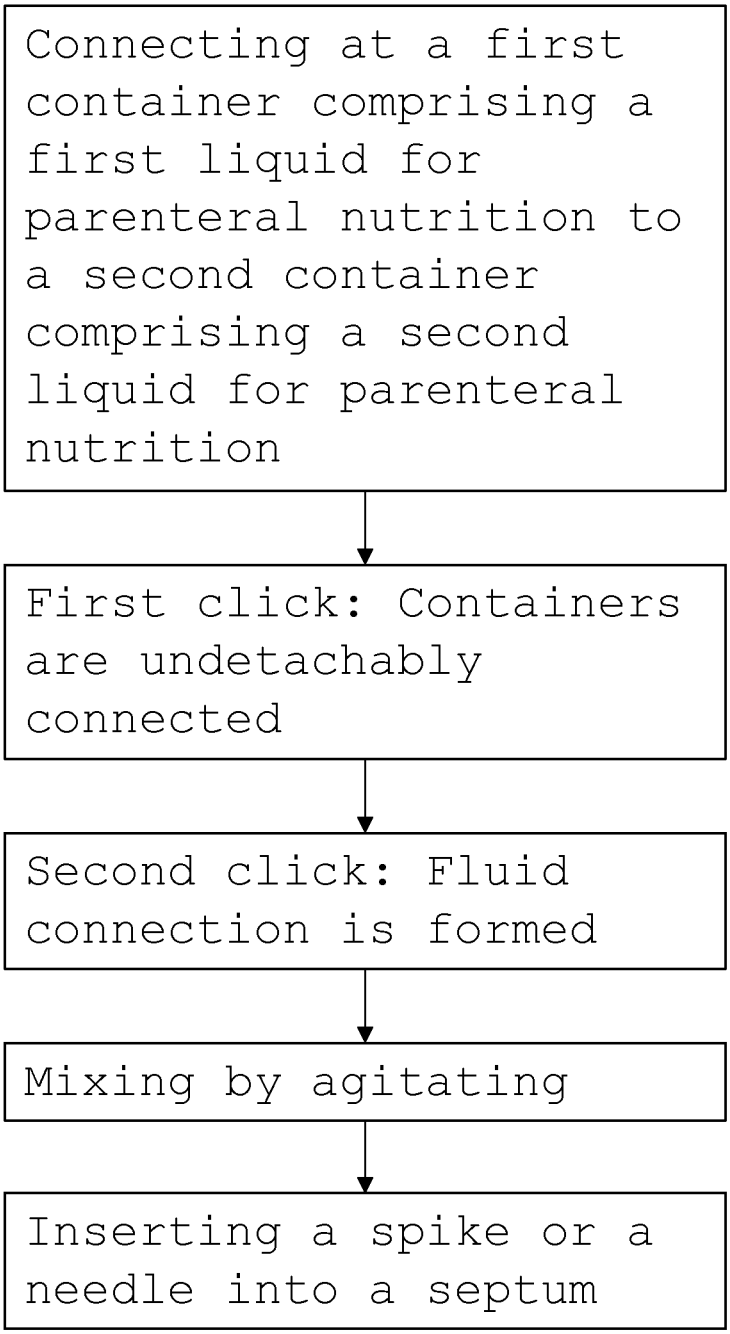
FIG. 27 is a flow chart of a method to mix parenteral nutrition according to an embodiment of the invention.

FIG. 27 is a flow chart of a method of mixing parenteral nutrition according to an embodiment of the invention.

A first container 2, 2*a*-2*d* comprising a first liquid for parenteral nutrition is connected to a second container 2, 2*a*-2*d* comprising a second liquid for parenteral nutrition.

In a first step, an undetachable mechanical connection is formed. This is signaled to the user by a first click. This is the first connection state of the containers 2, 2*a*-2*d*.

In a second step, a channel, which enables the passage of liquid, is formed and the containers 2, 2*a*-2*d* are undetachably locked. This represents the final second connection state of the containers 2, 2*a*-2*d*. The connected containers 2, 2*a*-2*d* provide a mixing volume for mixing the liquids of the containers 2, 2*a*-2*d* by agitating.

Then, a spike or a needle is inserted into a septum 32 to deliver the mixed parenteral nutrition to the patient, for instance via a feeding set.

The invention provides a very flexible system to mix individual compositions of parenteral nutrition.

Individual components with different amounts of ingredients can be prepared by the user or a preassembled mixing system can be provided.

Each component has its own lifetime, but the lifetime of all components is not dependent on the lifetime of the most perishable good. Components, which are easy to produce, e.g. glucose solutions, can be produced near to the end user and components, which are difficult to manufacture (e.g. fat emulsions) can be produced in a specialized production sites. Only those products have to be delivered over longer distances.

LIST OF REFERENCES

1 mixing system
2, 2*a*-2*d* container
3 hanger
4 cartridge
5 male connector
6 female connector
7 thread
8 grip
9 9*a*-9*c* membrane
10 collar
11 notch
12 duct
13 duct
14 lug
15 vial holder
16 cover (with grip)
17 receiving space
18 bending arm
19 engagement hook
20 membrane breaker insert
21 collar
22 cone shaped segment
23 channel
24 ring of breaker members
25 breaker member
26 top side
27 edge (of cone shaped segment)
28 sidewall
29 seal
30 annular projection
31 pre-cut
32 septum
33 foil (of closure)
34 bellows
35 inner member
36 outer member
37 step
38 resilient end section
39 edge
40 locking device
41 edge
42 secondary package
43 lid
44 marking
45 resilient section
46 pre-cut
47 female thread
48 septum module.

The invention claimed is:

1. A mixing system for parenteral nutrition, said mixing system comprising at least two containers that form a modular system, said at least two containers comprising a first container filled with a first liquid for parenteral nutrition and a second container filled with a second liquid for parenteral nutrition, wherein said mixing system further comprises a septum and a hanger, wherein said septum is pierceable by a spike or a needle, wherein said hanger is configured for attaching said mixing system to an infusion rack, wherein said first container comprises a male connector and said second container comprises a female connector that fits said male connector, wherein said first and second containers are configured to be coupled together by connecting said male and female connectors so as to form a channel that enables passage of liquid, said channel permitting mixing of said first and second liquids.

2. The mixing system of claim 1, wherein said at least two containers comprises a third container, wherein said first container contains amino acids, said second container contains glucose, and said third container contains fat.

3. The mixing system of claim 1, wherein said first container further comprises a female connector and said second container comprises a male connector that fits said female connector.

4. The mixing system of claim 1, wherein said at least two containers comprise a locking device for engaging a sealed non-detachable connection between said at least two containers, thereby forming a pre-assembled mixing system.

5. The mixing system of claim 4, wherein said locking device is configured to engage said non-detachable connection before formation of said channel.

6. The mixing system of claim 4, wherein said locking device is configured to provide an optical and/or acoustic signal when said containers are non-detachably connected and/or when said containers are non-detachably locked after forming said channel.

7. The mixing system of claim 1, wherein said containers are not-detachably locked when said channel is formed.

8. The mixing system of claim 1, wherein one of said first and second containers comprises said hanger and wherein said hanger is mounted in an area of said male or female connector.

9. The mixing system of claim 1, wherein said containers are blow-molded plastic containers.

10. The mixing system of claim 1, wherein said containers are coupled together by less than one turn of a screw.

11. The mixing system of claim 1, further comprising one of an ampoule and vial holder that is connectable to one of said first and second containers and a cartridge filled with a powdered ingredient, the cartridge being configured to be connected to said female connector.

12. The mixing system of claim 1, wherein said at least two containers are pre-assembled and inserted into a secondary package, wherein said secondary package comprises an oxygen diffusion barrier.

13. The mixing system of claim 1, wherein said make and female connectors are sealed with detachable tamper-evident closures.

14. The mixing system of claim 1, wherein at least one of said containers comprises a housing, wherein said housing is a bellows.

15. The mixing system of claim 1, wherein said septum is provided in one of said male and female connectors and wherein said septum comprises a connector that is configured for connection to said one of said male and female connectors.

16. The mixing system of claim 1, further comprising a membrane-breaker insert, said insert being a separate component that is placed between said male connector and said female connector.

* * * * *